US007334871B2

(12) United States Patent
Radominski et al.

(10) Patent No.: US 7,334,871 B2
(45) Date of Patent: Feb. 26, 2008

(54) FLUID-EJECTION DEVICE AND METHODS OF FORMING SAME

(75) Inventors: George Z. Radominski, Corvallis, OR (US); Steven D. Leith, Albany, OR (US); Timothy R. Emery, Corvallis, OR (US); Thomas H. Ottenheimer, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 373 days.

(21) Appl. No.: 10/810,270

(22) Filed: Mar. 26, 2004

(65) Prior Publication Data

US 2005/0212868 A1 Sep. 29, 2005

(51) Int. Cl.
*B41J 2/135* (2006.01)
*B41J 2/09* (2006.01)

(52) U.S. Cl. ..... 347/46; 347/77

(58) Field of Classification Search ..... 347/54, 347/46, 55, 52, 51, 77
See application file for complete search history.

(56) References Cited

U.S. PATENT DOCUMENTS

| | | | | |
|---|---|---|---|---|
| 2,273,433 | A | 2/1942 | Bruce | |
| 2,273,793 | A | 2/1942 | Ekstrand | |
| 2,291,476 | A | 7/1942 | Kernkamp | |
| 2,879,422 | A | 3/1959 | Borden et al. | |
| 2,894,799 | A | 7/1959 | McCreary | |
| 2,928,973 | A | 3/1960 | Crews | |
| 2,933,556 | A | 4/1960 | Barnes, Jr. | |
| 2,952,796 | A | 9/1960 | Crews et al. | |
| 2,963,606 | A | 12/1960 | Crews et al. | |
| 2,978,607 | A | 4/1961 | Borden | |
| 3,041,611 | A | 6/1962 | Moss | |
| 3,136,917 | A | 6/1964 | Stone, Jr. | |
| 3,157,811 | A | 11/1964 | Stone, Jr. | |
| 3,211,088 | A | 10/1965 | Naiman | |
| 3,234,561 | A | 2/1966 | Stone, Jr. | |
| 3,238,921 | A | 3/1966 | Engelstad et al. | |
| 3,321,657 | A | 5/1967 | Granitsas et al. | |
| 3,341,859 | A | 9/1967 | Adams | |
| 3,369,252 | A | 2/1968 | Adams | |
| 3,553,719 | A * | 1/1971 | Miyazaki | 347/52 |
| 3,582,954 | A | 6/1971 | Skala | |
| 3,622,825 | A | 11/1971 | Bennett | |
| 3,693,179 | A | 9/1972 | Skala | |
| 3,738,266 | A | 6/1973 | Maeda et al. | |
| 3,899,709 | A | 8/1975 | Brown et al. | |
| 4,166,277 | A | 8/1979 | Cielo et al. | |
| 4,210,080 | A | 7/1980 | Gundlach | |
| 4,455,561 | A | 6/1984 | Boyden et al. | |
| 4,459,601 | A | 7/1984 | Howkins | |
| 4,468,282 | A | 8/1984 | Neukermans | |
| 4,509,059 | A | 4/1985 | Howkins | |
| 4,520,375 | A | 5/1985 | Kroll | |
| 4,531,138 | A | 7/1985 | Endo et al. | |

(Continued)

FOREIGN PATENT DOCUMENTS

| | | |
|---|---|---|
| EP | 1008451 | 6/2000 |

*Primary Examiner*—K. Feggins

(57) ABSTRACT

The described embodiments relate to fluid-ejection devices and methods of forming same. One exemplary embodiment includes a plurality of fluid drop generators and associated electrically conductive paths, and at least one electron beam generation assembly configured to selectively direct at least one electron beam at individual electrically conductive paths sufficiently to cause fluid to be ejected from an associated fluid drop generator.

33 Claims, 23 Drawing Sheets

U.S. PATENT DOCUMENTS 4,646,106 A 2/1987 Howkins
4,723,131 A 2/1988 Droit
4,924,241 A 5/1990 Parks et al.
5,093,602 A * 3/1992 Kelly ..... 313/231.01
5,124,716 A 6/1992 Roy et al.
5,510,816 A 4/1996 Hosono et al.
5,534,900 A 7/1996 Ohno et al.
5,563,634 A 10/1996 Fujii et al.
5,644,341 A 7/1997 Fujii et al.
5,668,579 A 9/1997 Fujii et al.
5,713,673 A 2/1998 Nemoto et al.
5,734,395 A 3/1998 Kamisuki et al.
5,739,831 A 4/1998 Nakamura et al.
5,764,258 A 6/1998 Hetzer et al.
5,818,473 A 10/1998 Fujii et al.
5,821,951 A 10/1998 Fujii et al.
5,828,394 A 10/1998 Khuri-Yakub et al.
5,894,316 A 4/1999 Sakai et al.
5,912,684 A 6/1999 Fujii et al.
5,975,668 A 11/1999 Fujii et al.
5,992,978 A 11/1999 Fujii et al.
6,000,785 A 12/1999 Sakai et al.
6,117,698 A 9/2000 Atobe et al.
6,168,263 B1 1/2001 Nojima et al.
6,188,160 B1 2/2001 Main et al.
6,190,003 B1 2/2001 Sato et al.
6,213,588 B1 4/2001 Silverbrook
6,213,590 B1 4/2001 Fujii et al.
6,231,163 B1 5/2001 Silverbrook
6,234,607 B1 5/2001 Sakai et al.
6,299,291 B1 10/2001 Marusak
6,309,056 B1 10/2001 Sando et al.
6,312,108 B1 11/2001 Kato
6,315,394 B1 11/2001 Fujii
6,322,198 B1 11/2001 Hiaashino et al.
6,332,669 B1 12/2001 Kato et al.
6,341,847 B1 1/2002 Ohta et al.
6,343,852 B1 2/2002 Yoon
6,343,853 B1 2/2002 Masubuchi et al.
6,343,854 B1 2/2002 Kurosawa
6,345,884 B1 2/2002 Yoon et al.
6,354,696 B1 3/2002 Isshiki
6,354,697 B1 3/2002 Tanaka et al.
6,357,865 B1 3/2002 Kubby et al.
6,363,460 B1 3/2002 Jeddeloh
6,367,914 B1 4/2002 Ohtaka et al.
6,371,598 B1 4/2002 Fujii et al.
6,371,599 B1 4/2002 Hotomi et al.
6,394,582 B1 5/2002 Koeda
6,406,133 B1 6/2002 Abe
6,410,107 B1 6/2002 Sato et al.
6,416,164 B1 * 7/2002 Stearns et al. ..... 347/46
6,419,344 B2 7/2002 Fujii et al.
6,425,656 B1 7/2002 Koeda
6,447,107 B1 9/2002 Chino et al.
6,450,625 B1 9/2002 Fujii et al.
6,454,395 B1 9/2002 Irinoda
6,467,881 B2 10/2002 Katoh
6,474,786 B2 11/2002 Percin et al.
6,481,833 B1 11/2002 Fujii et al.
6,485,126 B1 11/2002 Kato et al.
6,497,474 B2 12/2002 Irinoda et al.
6,508,539 B2 1/2003 Tanaka
6,511,158 B2 1/2003 Tanaka
6,513,917 B1 2/2003 Matsuda et al.
6,517,195 B1 2/2003 Koeda
6,527,373 B1 3/2003 Delametter et al.
6,536,875 B1 3/2003 Pan
6,568,794 B2 5/2003 Yamanaka et al.
6,572,218 B2 6/2003 Gulvin et al.
6,577,370 B1 6/2003 Sato
6,592,208 B2 7/2003 Tanaka
6,601,947 B1 8/2003 Sato et al.
6,619,785 B1 9/2003 Sato
6,626,520 B1 9/2003 Hawkins et al.
6,655,787 B1 12/2003 Hawkins
6,752,488 B2 * 6/2004 Scott ..... 347/54
6,752,676 B2 6/2004 Yamashita et al.
2001/0000329 A1 4/2001 Sato et al.
2001/0020965 A1 9/2001 Fujii et al.
2001/0033311 A1 10/2001 Tanaka
2001/0038402 A1 11/2001 Percin et al.
2001/0055046 A1 12/2001 Tanaka
2002/0018100 A1 2/2002 Katoh
2002/0027576 A1 3/2002 Yamanaka et al.
2002/0033856 A1 3/2002 Moon et al.
2002/0036667 A1 3/2002 Shinavohuchi
2002/0047876 A1 4/2002 Irinoda et al.
2002/0054189 A1 5/2002 Irinoda
2002/0097303 A1 7/2002 Gulvin et al.
2002/0130925 A1 9/2002 Koeda
2002/0140786 A1 10/2002 Sugahara
2002/0140787 A1 10/2002 Takahashi
2002/0175980 A1 11/2002 Hashimoto et al.
2002/0180857 A1 12/2002 Silverbrook
2002/0191040 A1 12/2002 Tanaka
2003/0003618 A1 1/2003 Fujii et al.
2003/0085938 A1 5/2003 Imanaka et al.
2003/0098899 A1 5/2003 Jung et al.
2003/0151639 A1 8/2003 Takahashi
2003/0160836 A1 8/2003 Fukano et al.

* cited by examiner

FLUID-EJECTION DEVICE AND METHODS OF FORMING SAME

BACKGROUND

Drop-on-demand fluid-ejection devices can be utilized in many diverse applications such as printing and delivery of medicines. Another application can include dispensing liquid materials for bio-assays. Still another application can comprise printing electronic devices with the fluid-ejection device. Drop-on-demand fluid-ejection devices can comprise multiple fluid drop generators. Individual fluid drop generators can be selectively controlled to cause fluid drops to be ejected therefrom.

An important criterion for the operation of drop-on-demand fluid-ejection devices is printing speed. As such, it is often desired to increase printing speed of a drop-on demand fluid-ejection device.

The diversity of applications for which drop-on-demand fluid-ejection devices can be employed encourages designs which may be adaptable to various configurations and which may have a relatively low manufacturing cost.

BRIEF DESCRIPTION OF THE DRAWINGS

The same components are used throughout the drawings to reference like features and components wherever feasible. Alphabetic suffixes are utilized to designate different embodiments.

DETAILED DESCRIPTION

Exemplary fluid-ejection devices are described below. In some embodiments the fluid-ejection devices generally comprise an electron beam generation assembly (generation assembly) interfaced with a fluid assembly. The fluid assembly can contain an array of fluid drop generators. In some embodiments individual fluid drop generators can comprise a microfluidic chamber (chamber), an associated nozzle and one or more displacement units. The generation assembly can supply electrical charges to effect individual displacement units enabling on-demand fluid drop ejection from the various fluid drop generators.

The embodiments described below pertain to methods and systems for forming fluid-ejection devices. The various components described below may not be illustrated to scale. Rather, the included figures are intended as diagrammatic representations to illustrate to the reader various inventive principles that are described herein.

Figure 1:
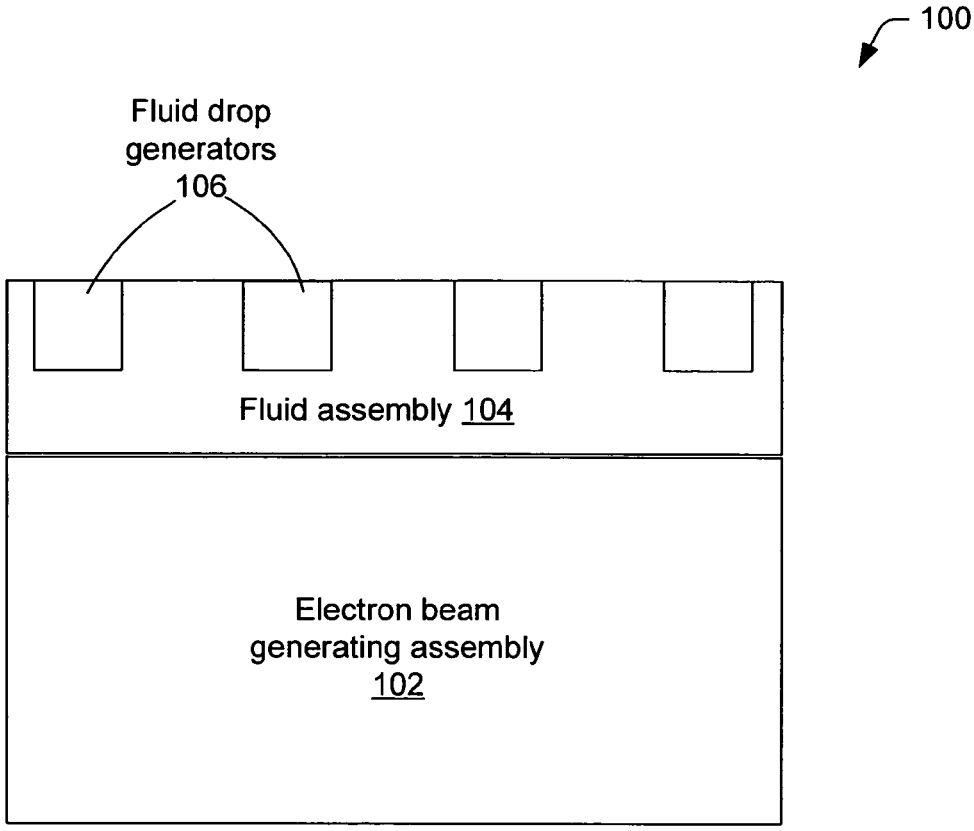
FIG. 1 illustrates a diagrammatic representation of an exemplary fluid-ejection device in accordance with one embodiment.

FIG. 1 illustrates a diagrammatic representation of an exemplary fluid-ejection device 100. In this particular embodiment fluid-ejection device 100 comprises a generation assembly 102 and a fluid assembly 104. Fluid assembly 104 can comprise a plurality of fluid drop generators 106. Generation assembly 102 can generate, during a predetermined time period, at least one electron beam for selectively controlling fluid ejection from individual fluid drop generators 106.

Figure 2:
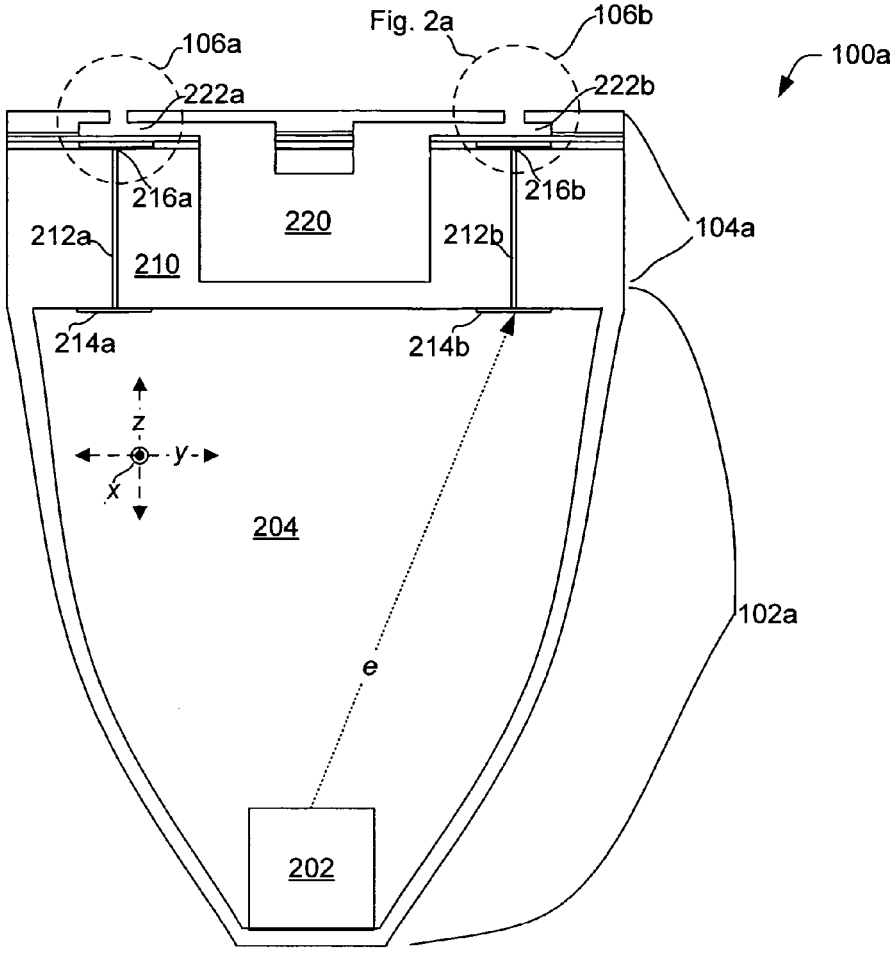
FIG. 2 illustrates a cross-sectional diagrammatic representation of another exemplary fluid-ejection device in accordance with one embodiment.
Figure 2A:
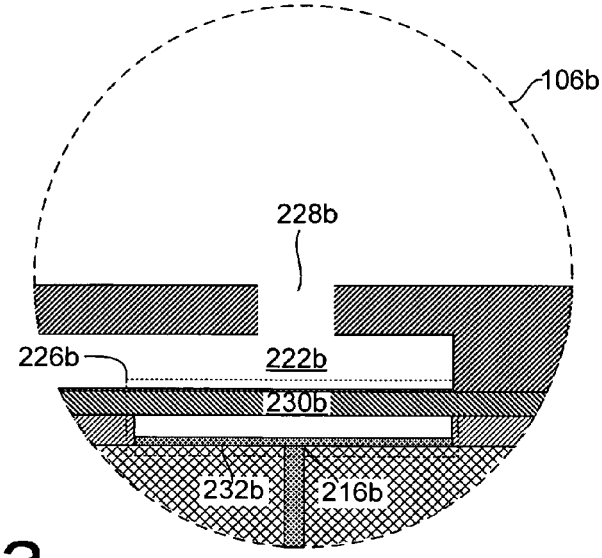
FIGS. 2*a*-2*c* illustrate slightly enlarged view of a portion of the embodiment of the fluid-ejection device as indicated in FIG. 2.

FIG. 2 illustrates a cross-sectional diagrammatic representation of another exemplary fluid-ejection device 100*a* having generation assembly 102*a* and fluid assembly 104*a*. FIG. 2*a* illustrates a slightly enlarged view of a portion of fluid-ejection device 100*a* as indicated in FIG. 2.

In some embodiments generation assembly 102*a* comprises one or more electron beam source(s) or electron guns 202. Other embodiments can employ one or more field emitters, which in one embodiment may be a source of electrons that relies on intense electric fields created by small dimensions to pull electrons from its surface. Some embodiments can utilize other types of electron sources. In this embodiment generation assembly 102*a* also comprises a vacuum tube 204 containing or otherwise associated with electron gun 202. Also in this embodiment vacuum tube 204 can be defined, at least in part, by a substrate 210 which also defines portions of fluid assembly 104*a* as will be described in more detail below. In this particular embodiment, electron gun 202 and vacuum tube 204 can comprise a cathode ray tube.

In this embodiment two electrically conductive paths 212*a*, 212*b* extend through substrate 210 between a first end 214*a*, 214*b* proximate vacuum tube 204 and a second end 216*a*, 216*b* proximate fluid drop generators 106*a*, 106*b* respectively. An individual conductive path such as conductive path 212*b* can receive electrical energy generated by electron gun 202 and deliver at least some of the energy proximate to fluid drop generator 106*b*. Fluid passageway 220 delivers fluid to chambers 222*a*, 222*b* for subsequent ejection. In this particular embodiment, electron gun 202, vacuum tube 204, substrate 210 and conductive paths 212*a*, 212*b* can comprise a cathode ray tube pin tube.

As can be appreciated from FIG. 2*a*, a displacement unit or structure indicated generally at 226*b* can displace fluid from chamber 222*b* resulting in fluid ejection from nozzle 228*b*. In this particular embodiment displacement unit 226*b* can comprise a displaceable assembly 230*b* positioned in proximity to a generally fixed assembly 232*b*. Displacement unit 226*b* can displace fluid through physical movement of one or more of its component parts which imparts mechanical energy to the fluid. As will be described in more detail below, such physical movement can be achieved in this embodiment via displaceable assembly 230*b*. Further, in some embodiments, displaceable assembly 230*b* can comprise an electrostatically deformable membrane as will be described in more detail below.

Figure 2B:
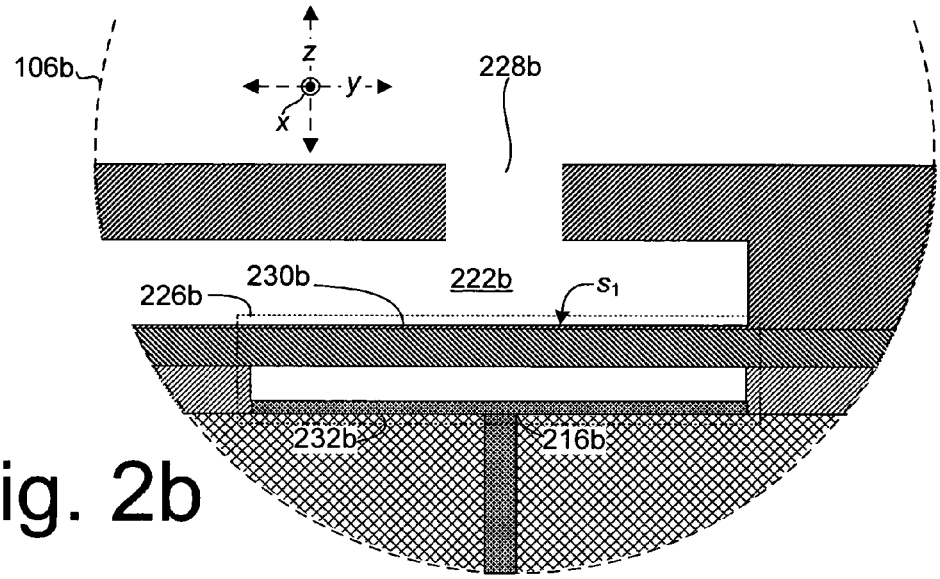
Figure 2C:
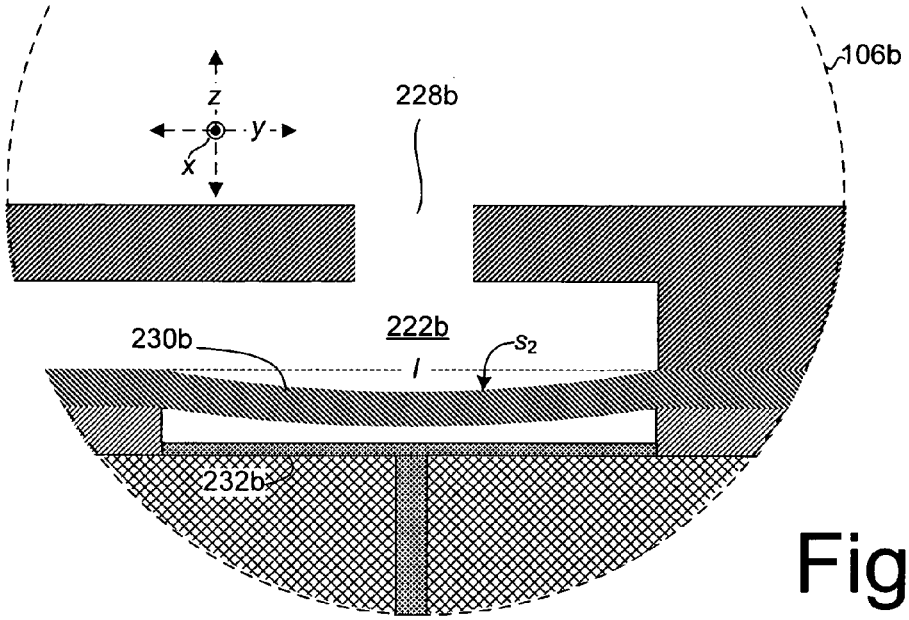

FIGS. 2*b*-2*c* illustrate further enlarged views of fluid drop generator 106*b* illustrated in FIG. 2*a*. FIGS. 2*b*-2*c* illustrate how one particular embodiment can eject fluid drops from fluid drop generator 106*b*. As illustrated in FIG. 2*b* displacement unit's displaceable assembly 230*b* is in a first position or state indicated generally as $s_1$. In this particular embodiment first state $s_1$ is a generally planar configuration which lies generally parallel to the xy-plane indicated in the drawing. Other embodiments can have other geometric configurations. One such example is provided below in relation to FIG. 7.

FIG. 2*c* illustrates displaceable assembly 230*b* where at least a portion is displaced from the first state or disposition $s_1$ (shown FIG. 2*b*) toward fixed assembly 232*b* to a second state or disposition $s_2$. A reference line l is added for purposes of explanation to illustrate z-direction displacement relative to the xy-plane. The magnitude of displacement relative to reference line l is for purposes of illustration and may not be accurately portrayed in FIG. 2*c*.

During operation generation assembly 102*a* can effect fluid ejection from the various fluid drop generators 106*a*, 106*b*. In this particular embodiment generation assembly 102*a* effects fluid ejection by addressing particular fluid drop generators to cause fluid to be ejected therefrom and by providing energy to drive the fluid ejection. For example, beginning with fluid drop generator's displaceable assembly 230*b* in the first state $s_1$ as illustrated in FIG. 2*b*, electron beam e can be steered so that it is directed at conductive path's first end 214*b*. The electron beam can produce a net negative charge in conductor's second end 216*b* which in this particular embodiment is electrically coupled to fixed assembly 232*b*. In this particular embodiment displaceable assembly 230*b* can have a relative positive charge and can be displaced toward fixed assembly 232*b* to the second state $s_2$ as illustrated in FIG. 2*c*. Directing electron beam e away from first end 214*b* causes the negative charge associated with fixed assembly 232*b* to dissipate and thus diminish the electrostatic attraction with displaceable assembly 230*b*. The displaceable assembly subsequently returns to its first state $s_1$ and can create mechanical energy on fluid within chamber 222*b* sufficient to eject a fluidic drop from nozzle 228*b*.

Figures 3, 3A:
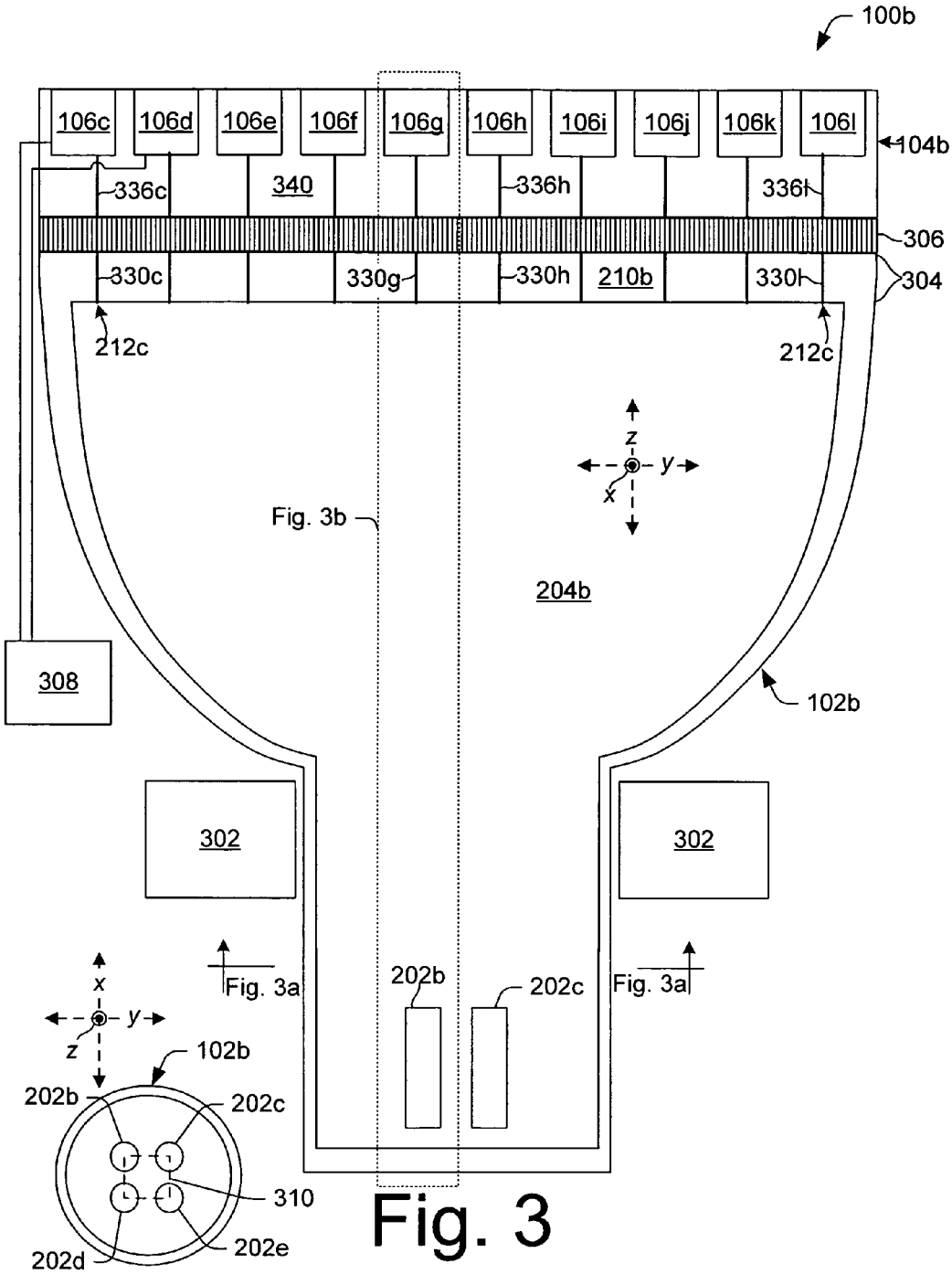
FIG. 3 illustrates a diagrammatic representation of a cross-sectional view of another exemplary fluid-ejection device in accordance with one embodiment.
FIGS. 3*a*-3*b* illustrate diagrammatic representations of cross-sectional views of a portion of an embodiment of the exemplary fluid-ejection device as indicated in FIG. 3.
Figure 3B:
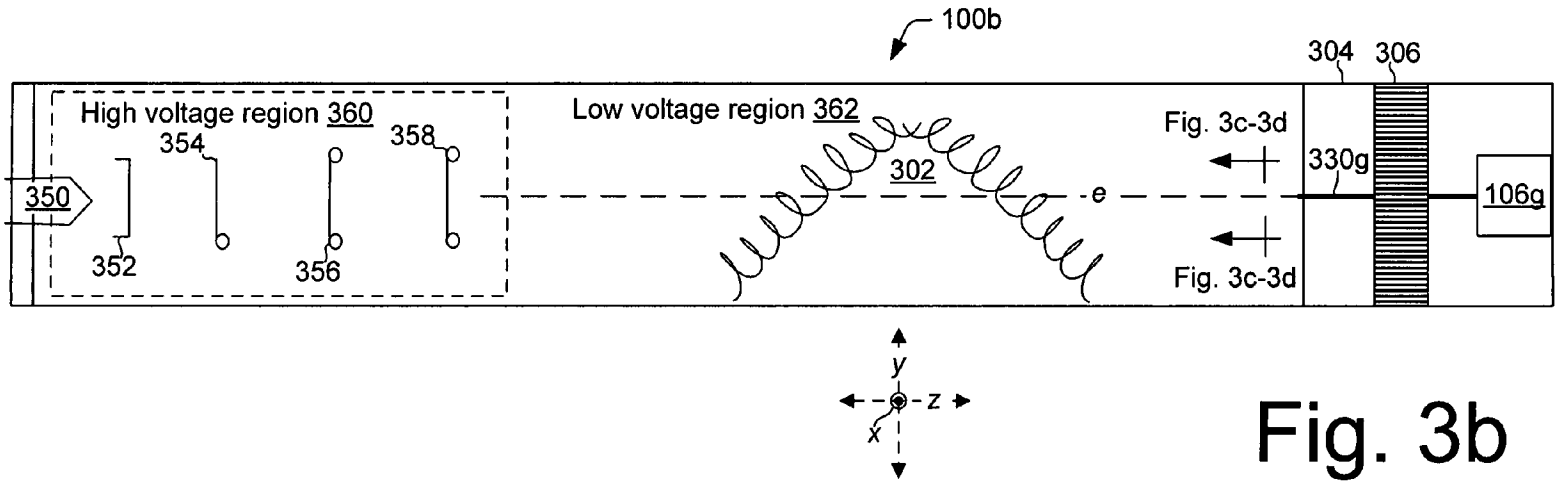
Figure 3D:
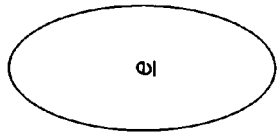
FIGS. 3*c*-3*d* illustrate diagrammatic representations of cross-sectional views of a portion of an exemplary electron beam shape as indicated in FIG. 3*b*.
Figure 3C:
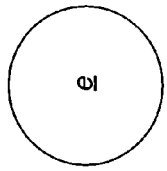

FIGS. 3-3*e* illustrate another exemplary fluid-ejection device 100*b* comprising generation assembly 102*b* and fluid assembly 104*b*. FIG. 3 illustrates a high level cross-sectional view taken generally along the yz-plane. FIG. 3*a* illustrates a cross-sectional view of a portion of fluid-ejection device 100*b* as indicated in FIG. 3. FIG. 3*b* illustrates a portion of fluid-ejection device 100*b* as indicated in FIG. 3. FIGS. 3*c*-3*d* illustrate cross-sectional representations of an exemplary electron beam configuration as indicated in FIG. 3*b*.

As can be appreciated from FIGS. 3-3*a*, in this embodiment generation assembly 102*b* has four electron guns 202*b*-*e* positioned within vacuum tube 204*b*. Electron guns 202*b*-202*e* can be configured to direct electron beams toward substrate 210*b* via a beam deflection means or deflection mechanism 302. In this particular embodiment deflection mechanism 302 can comprise a yoke. Other suitable embodiments may alternatively or additionally comprise deflection plates among others. Deflection mechanism 302 can achieve its functionality through various mechanisms including but not limited to electromagnetic and/or electrostatic deflection.

In this embodiment substrate 210*b* can define, at least in part, a pin or conductor plate 304. Positioned between pin plate 304 and fluid assembly 104*b* is an interface 306 which can allow generation assembly 102*b* to be coupled to fluid assembly 104*b*.

Function of the fluid assembly's fluid drop generators 106*c*-106*l* can be effected by a first signal generating means and a second signal generating means. In this embodiment the first signal generating means can comprise a voltage source 308 which is electrically coupled to individual fluid drop generators. Also in this embodiment the second signal generating means can comprise generation assembly 102*b*. Examples of these two signal generating means will be described in more detail below in relation to FIGS. 5-5*k*. Other embodiments may utilize other first and second signal generating means. Still other embodiments may utilize a single signal generating means to control an individual fluid drop generator. One such example is provided above in relation to FIGS. 2-2*c*.

In this embodiment generation assembly 102*b* and fluid assembly 104*b* can each comprise modular units. Such modularity can allow manufacturing and/or cost advantages. Further, such modularity can, in some embodiments, allow either the fluid assembly or the generation assembly to be replaced as an alternative to replacing the entire fluid-ejection device. For example some embodiments can removably assemble generation assembly 102*b* and fluid assembly 104*b* with the interface positioned therebetween. The fluid-ejection device can be disassembled to allow replacement of one or more of the generation assembly 102*b*, fluid assembly, 104*b* and interface 306.

As can be appreciated from FIG. 3*a*, in this particular embodiment the four electron guns 202*b*-202*e* are oriented to generally comprise four corners of a rectangle as indicated generally at 310. Other embodiments that employ multiple electron guns may utilize other configurations. In one such example multiple electron guns can be positioned in a generally linear fashion relative to one another. The positioning and location of electron guns 202*b*-202*e* are only constrained, in that, any electron beam generated by the electron guns is to be able to be directed to pin plate 304.

Multiple electrically conductive paths 212*c*-212*l* (not all of which are specifically designated) extend between pin plate 304 and individual fluid drop generators 106*c*-106*l*. In this embodiment at least a portion of electrically conductive paths 212*c*-212*l* can comprise conductors or pins 330*c*-330*l* (not all of which are specifically designated) extending through pin plate 304. In this embodiment conductors 330*c*-330*l* are positioned in generally electrically insulative or dielectric substrate material 210*b* which can electrically isolate individual conductors from one another. Examples of pin plate construction are provided below.

In this particular embodiment interface 306 is a generally compliant material, e.g. a rubber material, that in one embodiment is coated with a material making it generally electrically conductive along the z-axis and generally electrically insulative along the x and y-axes. Interface 306 can comprise a portion of the multiple electrically conductive paths 212*c*-212*l* and can allow electrical energy to flow from individual conductors 330*c*-330*l* of pin plate 304 into individual conductors or pins 336*c*-336*l* (not all of which are specifically designated) that supply individual fluid drop generators 106*c*-106*l*. Conductors 336*c*-336*l* can be formed in a substrate 340 of fluid assembly 104*b*.

In this particular embodiment fluid assembly 104*b* has an array of ten fluid drop generators 106*c*-106*l* generally arranged along the y-axis. The skilled artisan should recognize that other embodiments may have hundreds or thousands of fluid drop generators in an array. Similarly this cross-sectional view can represent one of many which can be taken along the x-axis to intercept different arrays. For example one embodiment can have 100 or more arrays arranged generally parallel to the x-axis with each array having 100 or more fluid drop generators arranged generally parallel to the y-axis. Some embodiments may also utilize a staggered or offset configuration of fluid drop generators relative to one or more axes. Such a staggered configuration may aid in achieving a desired fluid drop density in some embodiments.

FIG. 3*b* illustrates a portion of fluid-ejection device 100*b* as indicated in FIG. 3 in a little more detail. FIG. 3*b* illustrates components of individual electron guns utilized in this embodiment. Specifically FIG. 3*b* illustrates components of electron gun 202*b*. In this embodiment each of the electron guns has a similar configuration though such need not be the case. Electron gun 202*b* comprises a heater 350, a cathode 352, a grid 354, an anode 356, and a focus 358 which can be positioned in a high voltage region 360 of generation assembly 102*b*. Heater 350 can supply energy to excite cathode 352 sufficiently to emit electrons. Grid 354, anode 356, and focus 358 can shape and focus the electrons into a desired electron beam e as well as changing the number of electrons comprising electron beam e. The voltages utilized in this embodiment can be consistent with those known in the art. For example high voltage region 360 can be driven in some embodiments in a range of 5,000 volts to 20,000 volts. Other values may be utilized in some embodiments. The skilled artisan should recognize other electron gun configurations may be utilized with the embodiments described herein.

Figure 4A:
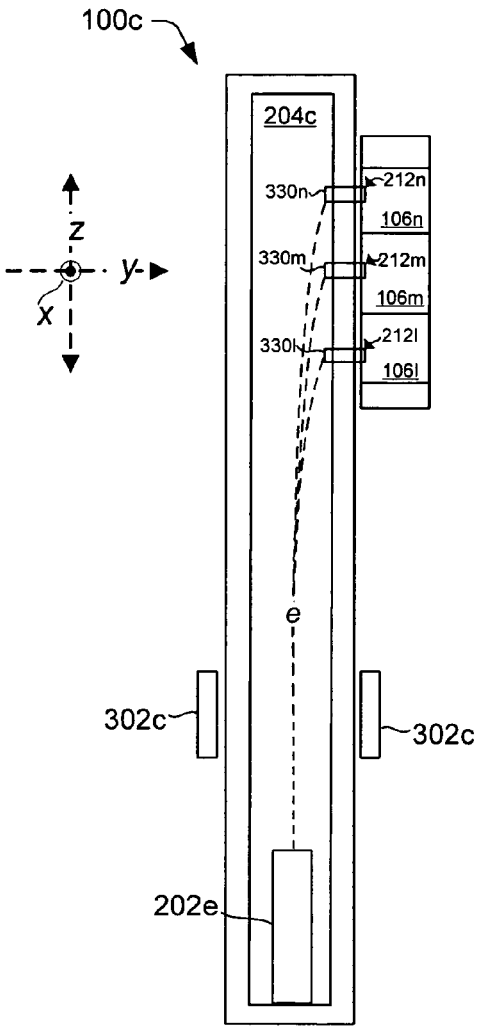
FIGS. 4*a*-4*b* illustrate diagrammatic representations of cross-sectional views of exemplary fluid-ejection devices in accordance with one embodiment.
Figure 4B:
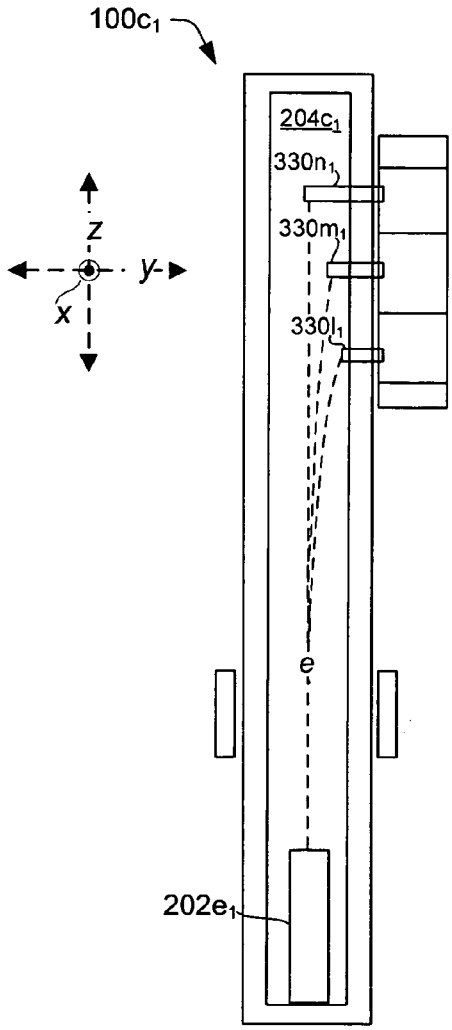

In this particular embodiment electron beam e is emitted from electron gun 202*b* parallel to the z-axis. Similarly, pin 330*g* extends generally parallel to the z-axis. In other embodiments such conductors may extend at obtuse angles relative to the electron beam. FIGS. 4*a*-4*b* illustrate embodiments where the conductors extend orthogonally to the axis of electron emission. The skilled artisan should recognize other electron gun configurations.

Examples of exemplary electron beam shapes are illustrated in FIGS. 3*c*-3*d*. Various exemplary embodiments can utilize electron beams having various cross-sectional dimensions and/or shapes. FIG. 3*c* illustrates a generally circular shape, while FIG. 3*d* illustrates a generally elliptical shape. Other exemplary shapes can include generally rectangular and square shapes among others. Beam size and shape can be adjusted, among other factors, to generally coincide with the cross-sectional shape and area of the pin plate's conductors 330*c*-330*l*.

In this particular embodiment deflection mechanism 302 is positioned proximate a low voltage region 362 of fluid-ejection device 100*b*. Deflection mechanism 302 can steer electron beam(s) e in the x and y-directions so that the beam e is directed at desired regions of pin plate 304. Beam current, as effected by the electron gun, can vary the energy imparted to an individual pin, such as 330*g*, in what is sometimes referred to as "z-axis modulation". As will be discussed in more detail below, such energy variation may be utilized in some embodiments to effect a size of a fluid drop ejected from an individual fluid drop generator 106*g* associated with pin 330*g*. The skilled artisan should recognize that other embodiments may utilize deflection plates instead of or in combination with deflection mechanism 302.

In operation, an electron beam from electron guns 202*b*-202*e* can be stepped or scanned across the surface of pin plate 304 at high rates thereby maintaining fluid drop generators in a distended position. If the electron beam skips over a pin plate position during a scan or step operation, then that fluid ejection element is actuated to eject ink. Other operation scenarios relating to the interaction of the fluid ejection elements and the electron beams are described above and below.

FIGS. 4*a*-4*b* illustrate additional exemplary fluid-ejection device configurations. In the embodiment represented in FIG. 4*a*, fluid-ejection device 100*c* comprises vacuum tube 204*c* encompassing a single electron gun 202*e*, though multiple guns also can be utilized. Electron gun 202*e* is configured to generate one or more electron beams e which can be directed by deflection mechanism 302*c* toward conductors 330*l*-330*n*. Individual conductors 330*l*-330*n* can comprise at least a portion of electrically conductive paths 212*l*-212*n* respectively extending between vacuum tube 204*c* and individual fluid generators 106*l*-106*n*.

FIG. 4*b* illustrates still another exemplary fluid ejection device 100$c_1$. In this particular embodiment conductors 330$l_1$-330$n_1$ extend into vacuum tube 204*c*, non-uniform distances. In this particular configuration conductors protrude farther into the vacuum tube with increasing distance from electron gun 202$c_1$. Such a configuration can aid in directing electron beam e at a desired pin.

As can be appreciated from FIG. 4*a*, electron beam e can be emitted from electron gun 202*e* generally along the z-axis. Deflection mechanism 302*c* can bend or steer electron beam e along the y-axis toward individual conductors 106*l*-106*n*. Similarly, though not illustrated in this cross-sectional view electron beam e can alternatively or additionally be steered along the x-axis. The dotted lines representing electron beam e in FIG. 4*a* are intended to illustrate that the electron beam e can be steered to any one of the conductors rather than to indicate that the electron beam is being steered to all three conductors 106*l*-106*n* simultaneously. In this particular embodiment conductors 330*l*-330*n* generally extend parallel to the y-axis and electron beam e is emitted from electron gun 202*e* generally orthogonally to the y-axis. FIG. 3 above illustrates one example where the electrons are emitted generally parallel to an axis along which the conductors extend. The skilled artisan should recognize that other configurations may be utilized with the embodiments described herein.

Figure 5:
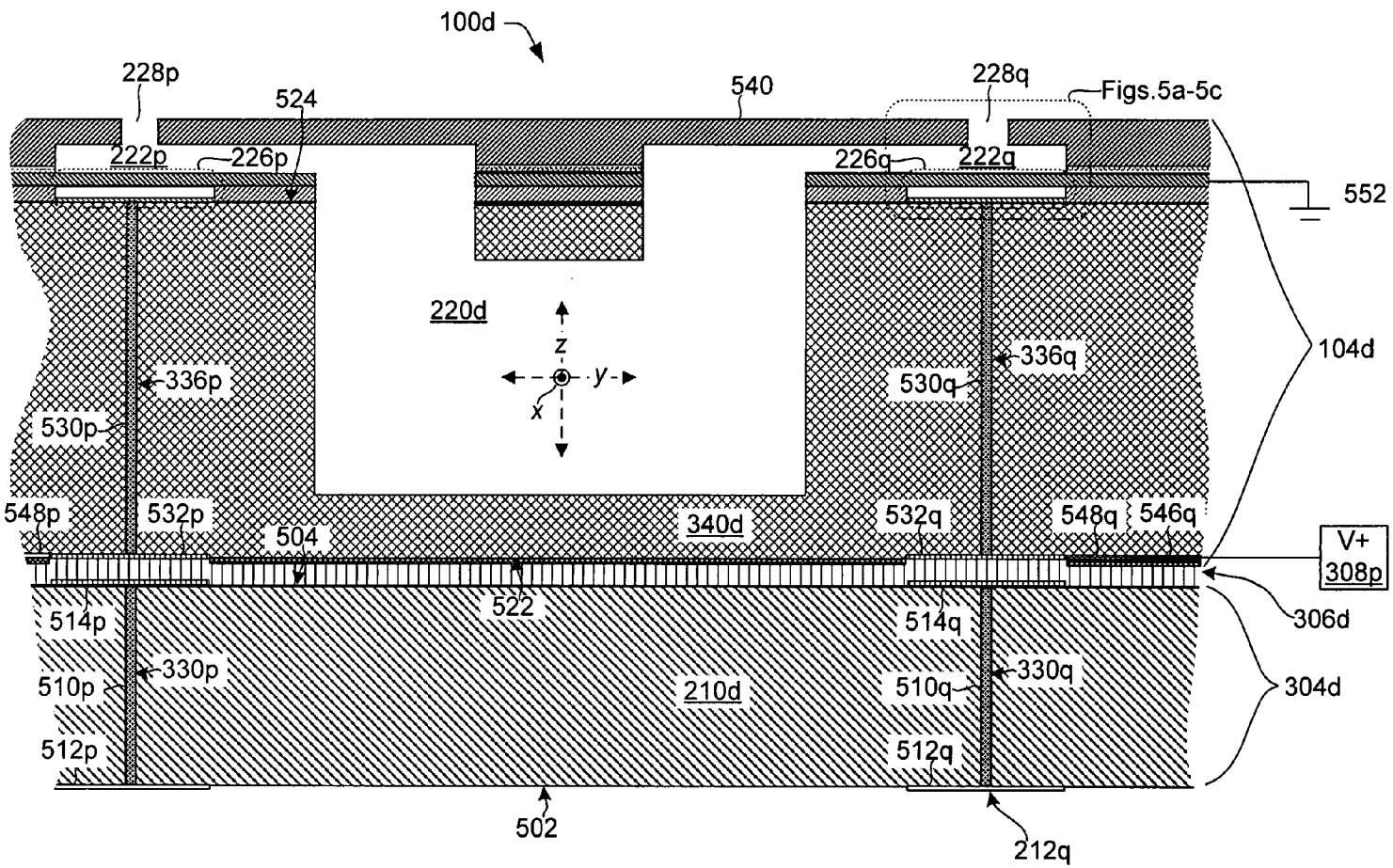
FIG. 5 illustrates a diagrammatic representation of a cross-sectional view of a portion of another exemplary fluid-ejection device in accordance with one embodiment.
Figure 5A:
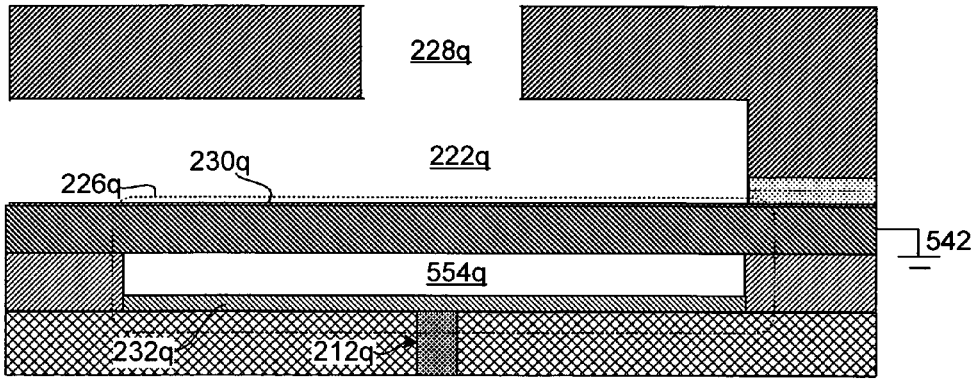
FIGS. 5*a*-5*d* illustrate one exemplary fluid ejection process from an exemplary fluid-ejection device in accordance with one embodiment.

FIGS. 5-5*a* illustrate cross-sectional representations of a portion of another exemplary fluid-ejection device 100*d*. As indicated in FIG. 5, FIG. 5*a* illustrates a portion of the fluid ejection device in a little more detail. In this embodiment pin plate 304*d* comprises a portion of a vacuum tube (not shown). Pin plate 304*d* comprises conductors 330*p*, 330*q* and electrically insulative substrate 210*d*. Conductors 330*p*, 330*q* extend between a first surface 502 of substrate 210*d* and a second substrate surface 504. Individual conductors have a central portion 510*p*, 510*q* extending between a first terminal portion 512*p*, 512*q* positioned proximate first surface 502 and a second terminal portion 514*p*, 514*q* positioned proximate second surface 504. In this particular embodiment the terminal portion may be enlarged to have greater surface area in the xy-plane. Such a configuration can allow easier alignment among various components among other attributes. When viewed generally along the z-axis first terminal portions 512*p*, 512*q* can be shaped and/or sized to generally coincide with the shape of the electron beam as discussed above in relation to FIGS. 3*b*-3*d*.

In this embodiment fluid assembly substrate 340*d* extends generally between first and second surfaces 522, 524. Individual conductors or conductors 336*p*, 336*q* of fluid assembly 104*d* have a central portion 530*p*, 530*q* extending through substrate 340*d* and between a first terminal portion 532*p*, 532*q* positioned proximate first surface 522 and a second terminal portion positioned proximate second surface 524. As noted above some embodiments may enlarge the terminal portions along the xy-plane for alignment and/or other purposes.

In this embodiment a single fluid channel 220*d* is configured to supply fluid to both chambers 222*p*, 222*q*. Fluid channel 220*d* can refill chambers 222*p*, 222*q* to replace fluid ejected through nozzles 228*p*, 228*q* respectively which are formed in orifice layer or orifice array 540. Other embodiments can have other supply configurations as should be recognized by the skilled artisan. Displacement units 226*p*, 226*q* can be positioned proximate chambers 222*p*, 222*q*.

Interface 306*d* can provide electrical coupling of the pin plate's individual conductors 330*p*, 330*q* to individual conductors 336*p*, 336*q* of fluid assembly 104*d*. Individual pin plate conductors 330*p*, 330*q*, fluid assembly conductors 336*p*, 336*q*, and an associated portion of interface 306*d* can comprise portions of electrically conductive paths. For example pin plate conductor 330*q*, interface 306*d*, and fluid assembly conductor 336*q* comprise at least a portion of electrically conductive paths indicated generally at 212*q*. These paths or pathways will be discussed in more detail below.

Voltage source 308*p* can be electrically connected to the displacement units 226*p*, 226*q*. In this particular embodiment voltage source 308*p* is connected to displacement unit 226*q* via conductive paths 212*q*. Specifically, in this particular embodiment voltage source 308*q* is electrically connected via conductor 546*q* to resistor 548*q* which is connected to electrically conductive path 212*q*. Electrically conductive path 212*q* is electrically connected to displacement unit 226*q*. Though not specifically shown voltage source 308*p* can be similarly electrically connected to displacement unit 226*p*.

In this particular embodiment resistors 548*p*, 548*q* are positioned on substrate 340*d* proximate interface 306*d*. Other suitable embodiments can position the resistors at other locations on the fluid-ejection device. For example, the resistors could be formed on the surface of substrate 340*d* proximate displacement units 226*p*, 226*q* or on either surface 502, 504 of pin plate 304*d*. Still other embodiments may utilize other configurations. For example in some embodiments conductors 546*q* and/or resistors 548*p*, 548*q* can be formed within substrate 340*d*. Alternatively or additionally to utilizing resistors 548*p*, 548*q* other exemplary embodiments can utilize various other passive or active (linear or non-linear) components. The skilled artisan should recognize such configurations.

As can be appreciated from FIG. 5*a*, displacement unit 226*q*, in this embodiment, can comprise displaceable assembly 230*q* and fixed assembly 232*q*. Further, in this embodiment displaceable assembly 230*q* is connected to an electrical ground indicated generally at 552. A dielectric region 554*q* can separate displaceable assembly 230*q* and fixed assembly 232*q*. In this particular embodiment dielectric region 554*q* can comprise air or other gases. Alternatively or additionally some embodiments may interpose an additional dielectric layer between displaceable assembly 230*q* and fixed assembly 232*q*. For example, the additional dielectric layer may be positioned on either or both of the opposing surfaces of displaceable assembly 230*q* and fixed assembly 232*q*. One such example is described below in relation to FIG. 5*c*. The skilled artisan should recognize other configurations that may be utilized with the embodiments described herein.

Figure 5B:
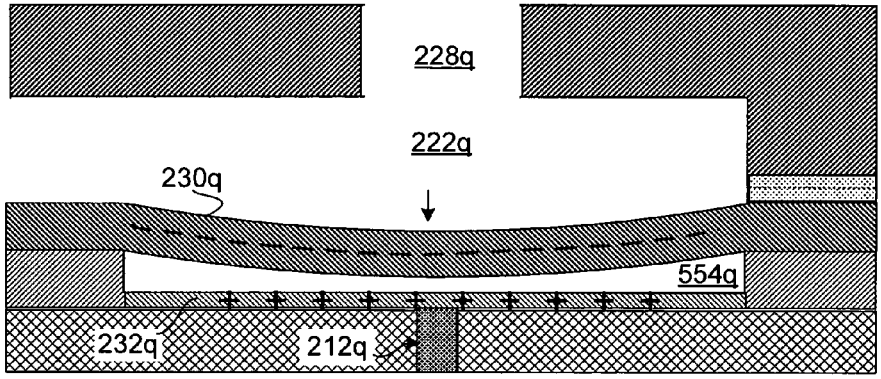
Figure 5C:
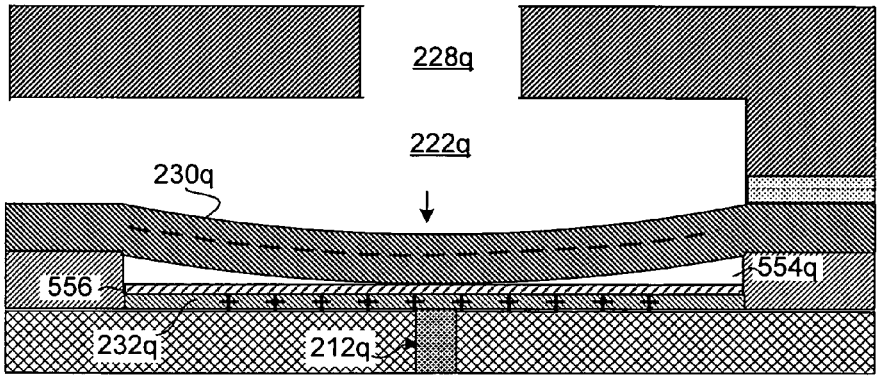

FIGS. 5*a*-5*c*, in combination with FIG. 5, illustrate an exemplary fluid ejection process from an exemplary fluid-ejection device 100*d*. In this embodiment displaceable assembly 230*q* can comprise a material such as a membrane that can be effected by a relative charge environment to which the material is exposed. As illustrated in FIG. 5*a* no substantial charge differential exists between displaceable assembly 230*q* and fixed assembly 232*q*.

Referring now to FIG. 5*b*, in combination with FIGS. 5-5*a*, activation of voltage source 544 sends a first signal to displacement unit 226*q*. This first signal can cause a relatively positive charge along electrically conductive path 212*q* and fixed unit 232*q* relative to a generally negative charge of displaceable assembly 230*q*. Displaceable assembly 230*q* can be attracted to and distend into dielectric region 554*q* toward fixed assembly 232*q*. As displaceable assembly 230*q* distends, fluid can be drawn into chamber 222*q* from fluid channel 220*d*.

FIG. 5*c* illustrates an alternative configuration where an additional dielectric layer is positioned interposed between displaceable assembly 230*q* and fixed assembly 232*q* on either of both of the opposing surfaces thereof. In this particular embodiment the additional dielectric layer, indicated generally at 560, is positioned over fixed assembly 232*q*. Such a configuration can allow displaceable assembly 230*q* to distend across dielectric region 554*q* and physically contact the fixed assembly's dielectric layer 558 without shorting. Such a configuration may allow some embodiments to achieve more uniform drop sizes among the respective fluid drop generators comprising an exemplary fluid ejection device. Such uniformity may be attributable, at least in part, to allowing displaceable assembly 230*q* to distend until it is physically blocked by the fixed assembly. Such a configuration can provide repeatability as it relates to a given displacement unit and/or between numerous displacement units.

Figure 5D:
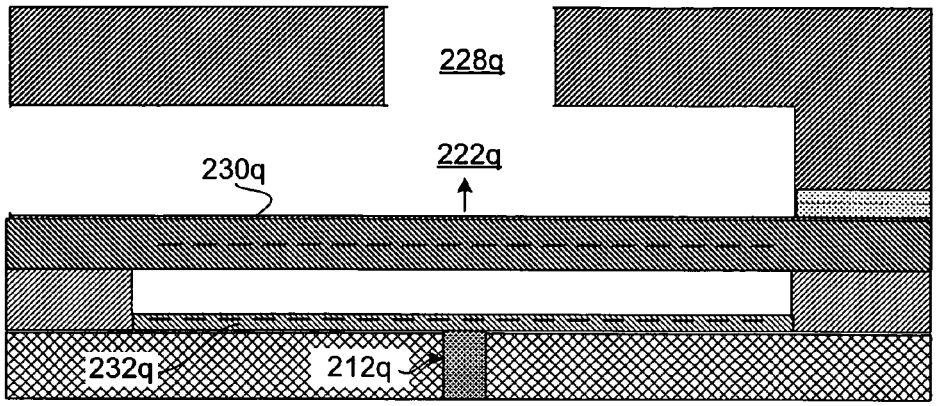

Reference now to FIG. 5*d* in combination with FIG. 5 where an electron beam (not shown) can comprise a second signal which can be conveyed to displacement unit 226*q*. In this particular embodiment the electron beam can be directed at terminal portion 512*q* to impart a relatively negative charge along electrically conductive path 212*q* and ultimately fixed assembly 232*q*. As such, the attractive forces which distended displaceable assembly 230*q* toward fixed assembly 232*q* are reduced by the second signal and displaceable assembly 230*q* returns to its original state and as such can provide a mechanism for ejecting fluid from nozzle 228*q*. In this particular instance movement of displaceable assembly 230*q* can impart mechanical energy on fluid contained in chamber 222*q*. Though not specifically shown, in some embodiments the displaceable assembly may oscillate past the xy-plane generally before coming to rest as illustrated in FIG. 5*c*. When the electron beam is no longer acting upon conductive path 212*q* the relative charge configurations illustrated in FIG. 5*b* can be re-established and the displaceable assembly can return to the position illustrated in FIG. 5*b* or 5*c*.

For purposes of explanation displaceable assembly 230*q* is illustrated in a fully displaced condition in FIG. 5*c* and the displaceable assembly returns to a generally planar configuration illustrated in FIG. 5*d* when effected by an electron beam via conductive path 212*q*. Other embodiments may result in the displaceable assembly 230*q* assuming one or more intermediate positions by controlling the electrical charge imparted upon the path by an electron beam. For example an electron beam can act upon conductive path 212*q* sufficiently to cause the displaceable assembly to have a decreased attraction to fixed assembly 232*q* such that the assembly moves to a position intermediate to those represented in FIGS. 5*c* and 5*d*. As such a relatively small fluid drop may be ejected from nozzle 228*q* when compared to a drop size produced from the movement of the displaceable assembly from the position illustrated in FIG. 5*c* to that illustrated in FIG. 5*d*. Such charge variation can comprise an example of z-axis modulation as described above in relation to FIG. 3*b* for producing controllably variable fluid drop size.

Figure 5E:
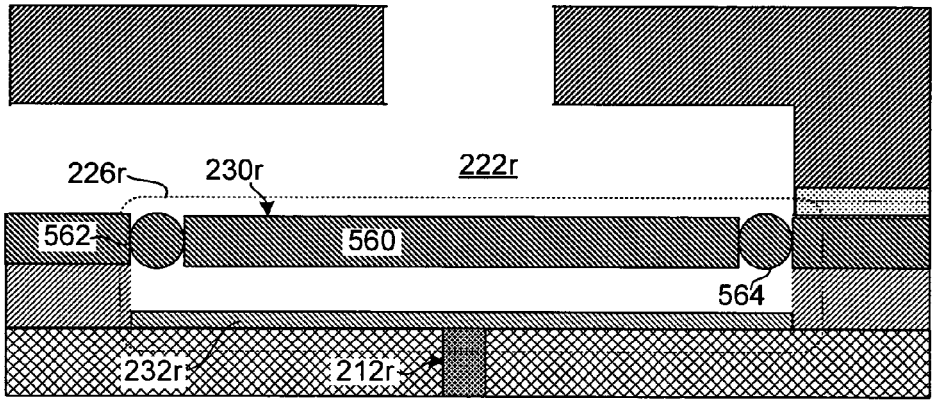
FIGS. 5*e*-5*f* illustrate diagrammatic representations of cross-sectional view of a portion of another exemplary fluid-ejection device in accordance with one embodiment.
Figure 5F:
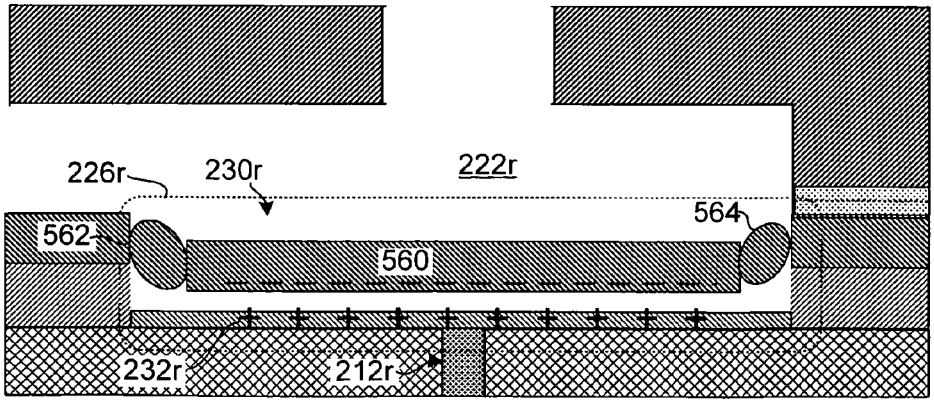

FIGS. 5*e*-5*f* illustrate displacement unit 226*r* having another exemplary configuration. In this embodiment displaceable assembly 230*r* comprises a generally rigid material 560 which extends between two compliant structures 562, 564. In this particular embodiment rigid material 560 can be moved relative to fixed assembly 232*r* utilizing relative charge as described above to impart mechanical energy on fluid contained in chamber 222*r*.

FIGS. 5-5*f* illustrate embodiments having a single displacement unit associated with a chamber. FIGS. 5*g*-5*k* illustrate another exemplary configuration that may among other attributes produce controllably variable fluid drop size. The views illustrated in FIGS. 5*g*-5*k* are similar to those illustrated in FIGS. 5*a*-5*f* and represent a portion of fluid-ejection device 100*e*.

Figure 5G:
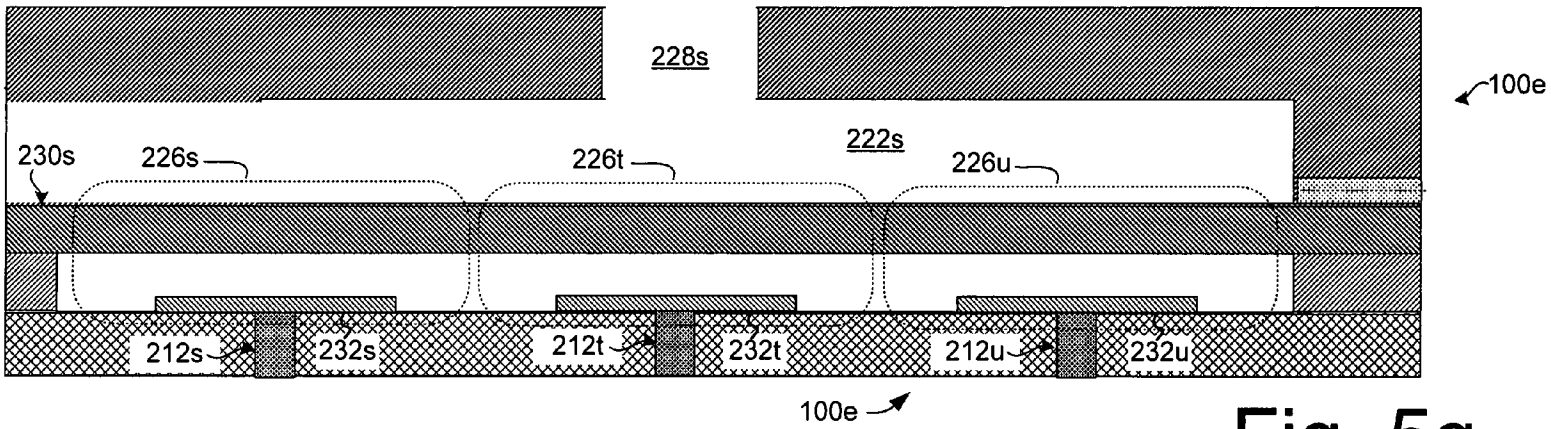
FIGS. 5*g*-5*k* illustrate diagrammatic representations of cross-sectional view of a portion of another exemplary fluid-ejection device in accordance with one embodiment.

As illustrated in FIG. 5*g*, in this embodiment fluid-ejection device 100*e* has multiple independently controllable conductive paths associated with an individual chamber. In this particular embodiment three independently controllable conductive paths 212*s*-212*u* are coupled to fixed assemblies 232*s*-232*u* respectively. In this particular embodiment the three displacement units share a common displaceable assembly 230*s*. Other embodiments may have distinctly divided components. One, two or all three of the fixed assemblies 232*s*-232*u* can be selectively charged by an electron beam to effect portions of displaceable assembly 230*s* associated with the various displacement units 226*s*-226*u*.

Figure 5H:
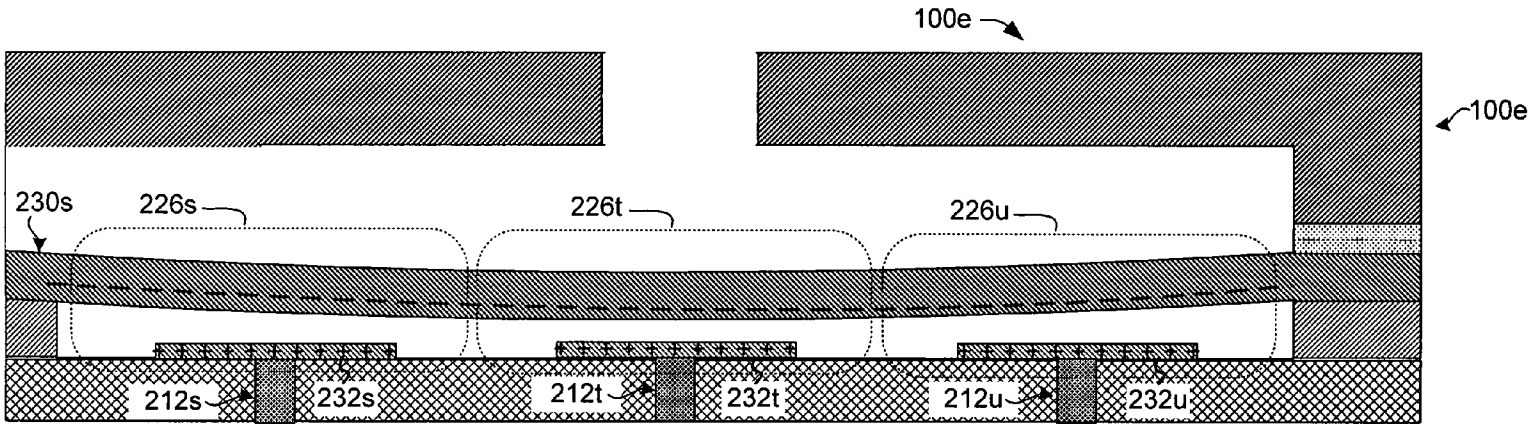

FIG. 5*h* illustrates each of the three fixed assemblies 232*s*-232*u* having a relatively positive charge and negatively charged displaceable assembly 230*s* being displaced toward the fixed assemblies for each of the displacement units 226*s*-226*u*.

Figure 5I:
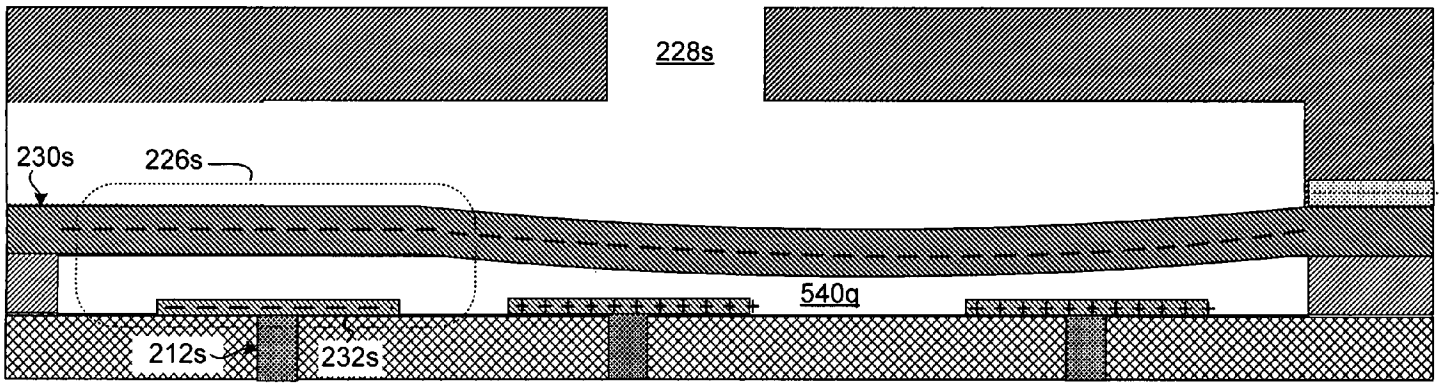

FIG. 5*i* illustrates an example where an electron beam has changed conductive path 212*s* and fixed assembly 232*s* from a generally positive charge to a generally negative charge. As a result, a portion of displaceable assembly 230*s* comprising displacement unit 226*s* has decreased attraction to the path and returns to a non-displaced configuration which can eject a fluid drop from nozzle 228*s*.

Figure 5J:
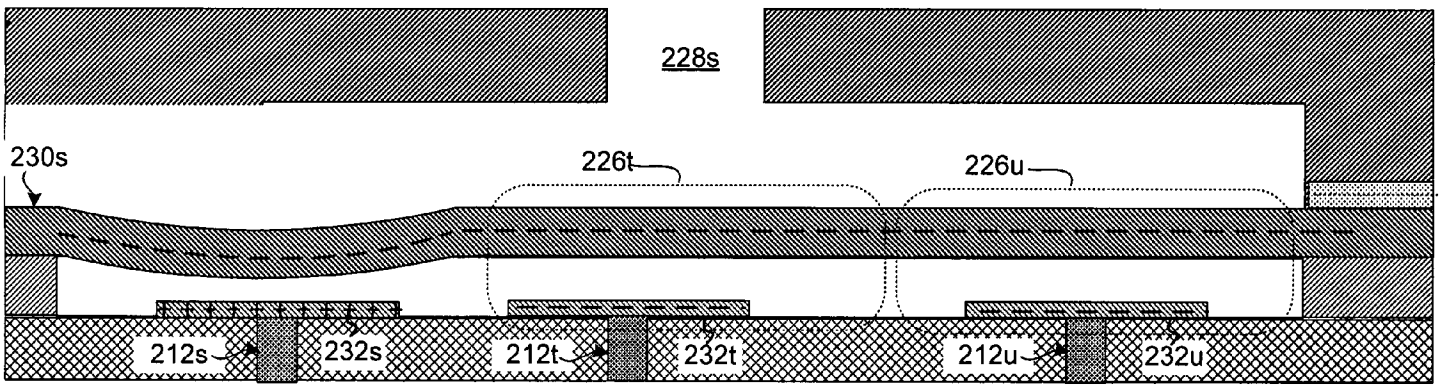

Similarly, FIG. 5*j* illustrates an example where an electron beam imparted a generally negative charge on fixed assemblies 232*t*, 232*u*. A second portion of displaceable assembly 230*s* associated with displacement units 226*t*, 226*u* returns to a non-displaced configuration which can cause a fluid drop to be ejected from nozzle 228*s*. In this instance the fluid drop may be larger than the fluid drop described in relation to FIG. 5*i*.

Figure 5K:
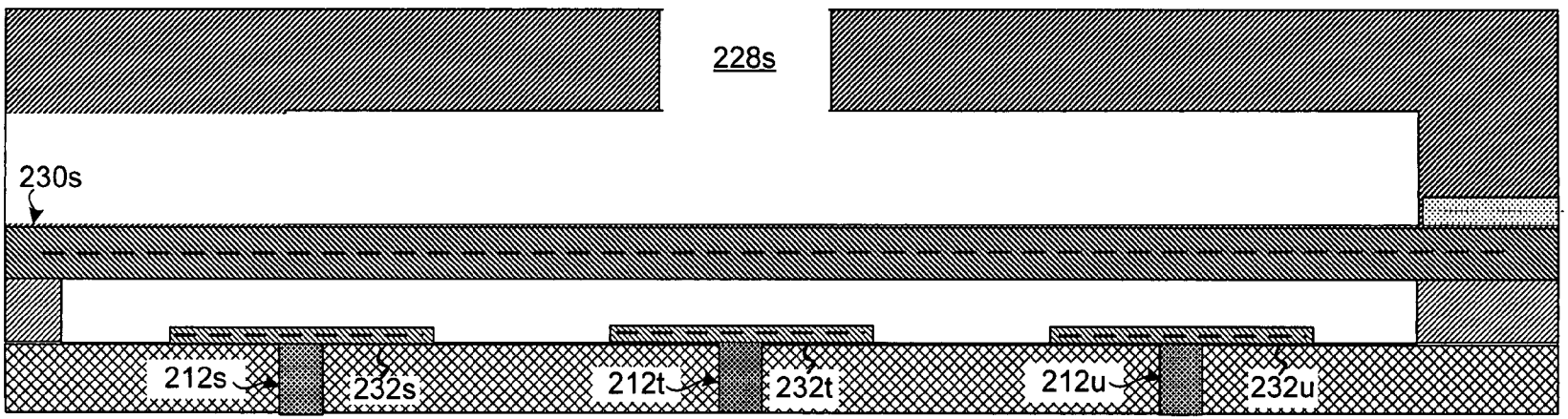

FIG. 5*k* shows still another possible example where an electron beam imparts a generally negative charge on each of the three conductive paths 212*s*-212*u* and associated fixed units 232*s*-232*u*. The negative charge decreases the attractive forces acting upon displaceable assembly 230*s* which returns to a non-displaced condition. As a result a fluid drop ejected from nozzle 228*s* may be larger than the fluid drops described in relation to FIGS. 5*i*-5*j*. The skilled artisan should recognize still other exemplary configurations.

FIGS. 5-5*j* are described in the context of an electron beam imparting a negative charge on conductive paths such as conductive path 212*q* illustrated in FIG. 5. However, the skilled artisan should recognize that other embodiments may be constructed to impart a positive charge on the conductive paths and to configure the fluid assembly accordingly. For example, a material, such as Magnesium oxide (MgO) can be positioned within the vacuum tube and over first terminal portion 512*q* such that an electron beam striking the material produces a secondary electron emission resulting in a net positive charge which is imparted along the path. Beam energy can be chosen to maximize secondary emission. As such, exemplary fluid-ejection devices can be configured which utilize the electron beam to impart either a relatively positive charge or a relatively negative charge on the paths to effect the displacement units. Alternatively or additionally to the example provided above, other materials may be utilized to optimize secondary emissions can comprise metals such as aluminum tantalum, nickel, iron, copper, chromium, zinc, silver, gold, and platinum among others. Other material can include metal alloys such as alloys of the metal listed above. Other materials can include metal oxides such as zinc oxide, tantalum oxide, and titanium oxide, among others. Still other materials can include ceramic materials such as alumina, ceria, silicon oxide, and silicon alloys such as silicon nitride and tungsten silicon nitride among others, and combinations of the above listed types of materials. The skilled artisan should recognize exemplary fluid-ejection devices which utilize each of these configurations.

The use of electron beam sources to actuate fluid ejection allows several advantages over known approaches. For example, electron beam sources can scan beams over the surface of plate 304 at rates approaching the gigahertz range. This may allow fluid ejection rates near the electron beam scan speeds.

Figure 6A:
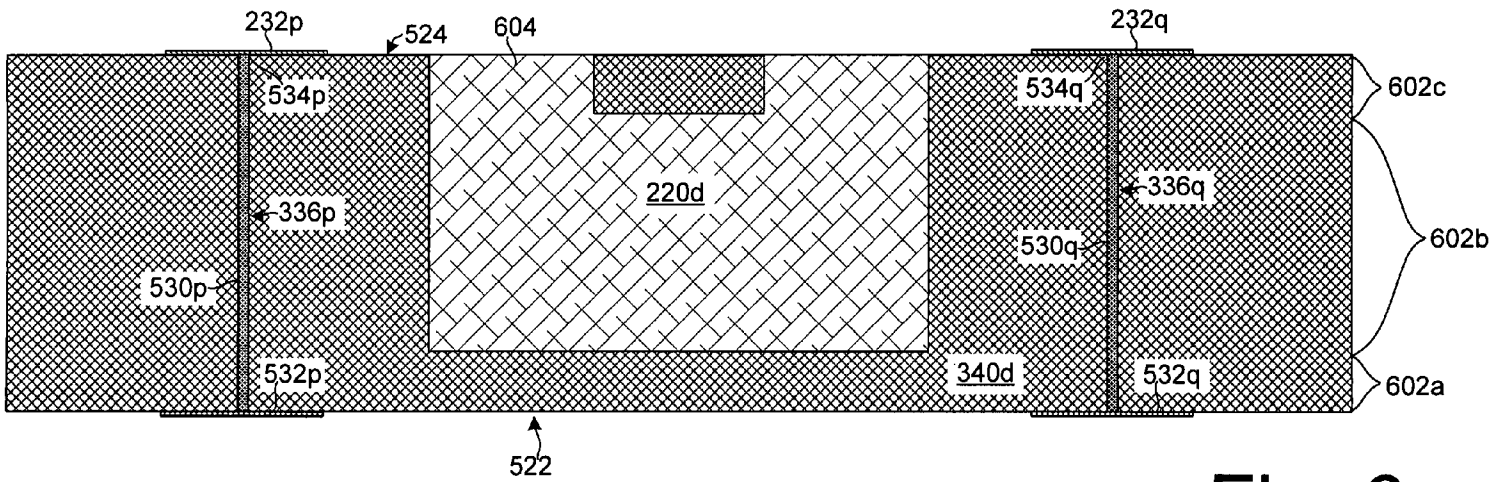
FIGS. 6*a*-6*r* illustrate diagrammatic representations of process steps for forming a portion of an exemplary fluid-ejection device in accordance with one embodiment.
Figure 6B:
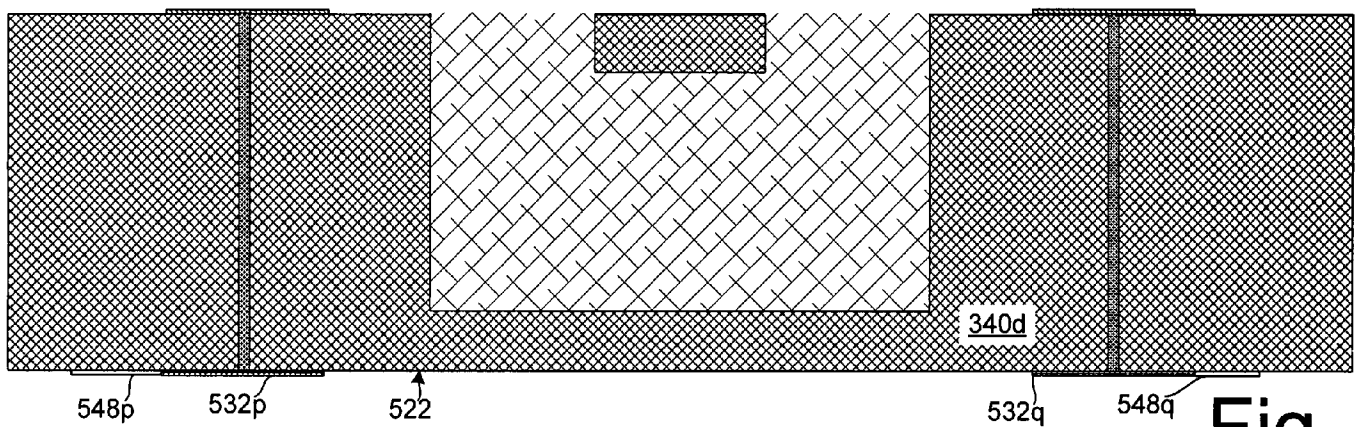
FIGS. 6*s*, 7, 8, and 9*a*-9*b* illustrate exemplary fluid ejection devices in accordance with one embodiment.
Figure 6C:
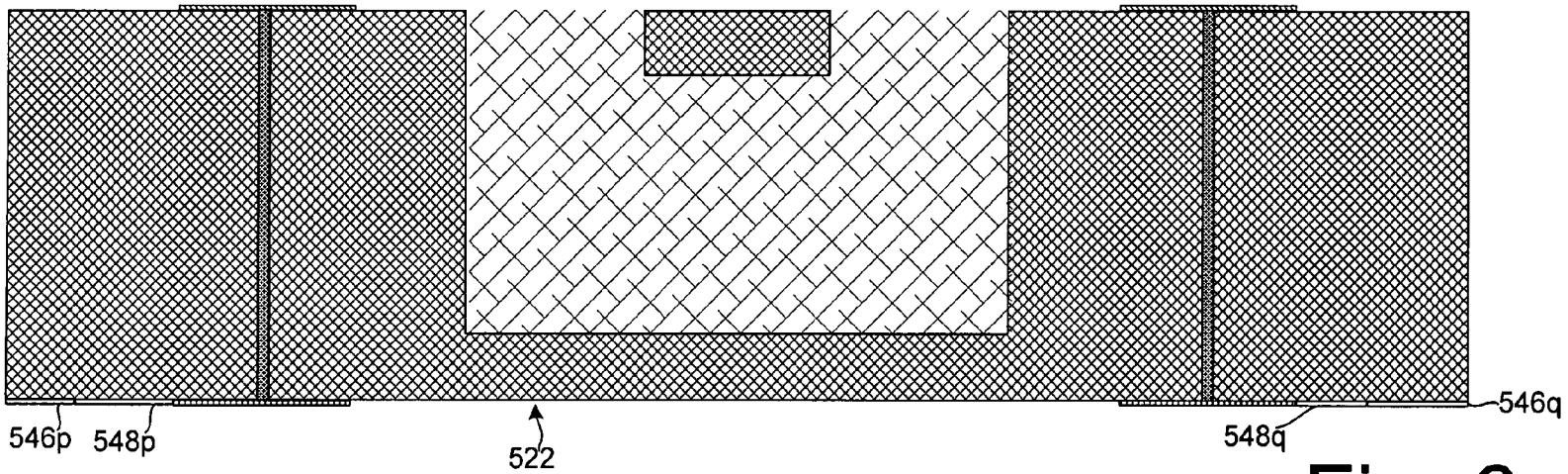
Figure 6D:
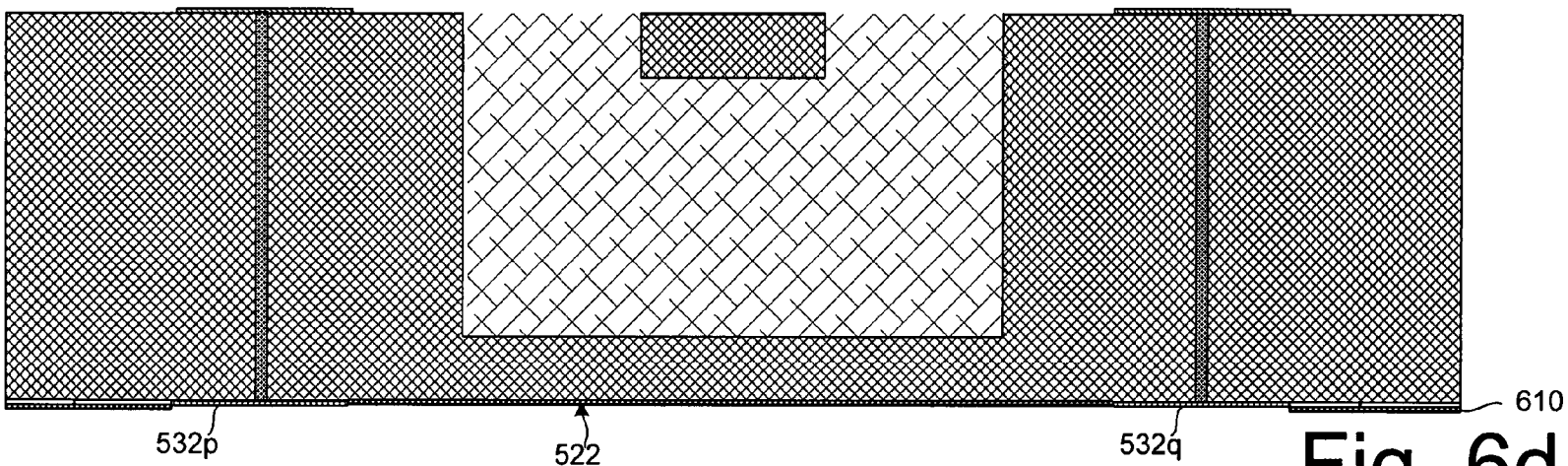
Figure 6E:
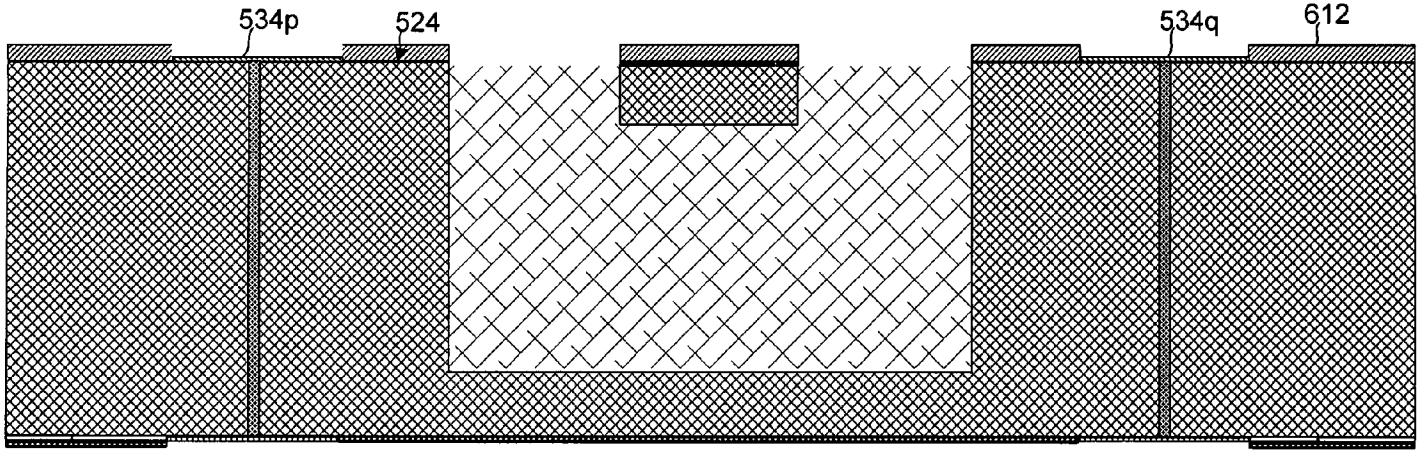
Figure 6F:
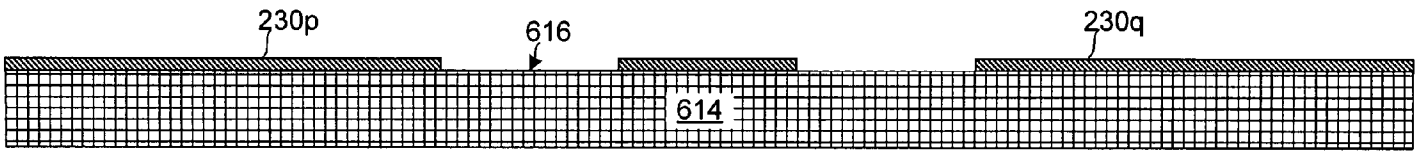
Figure 6G:
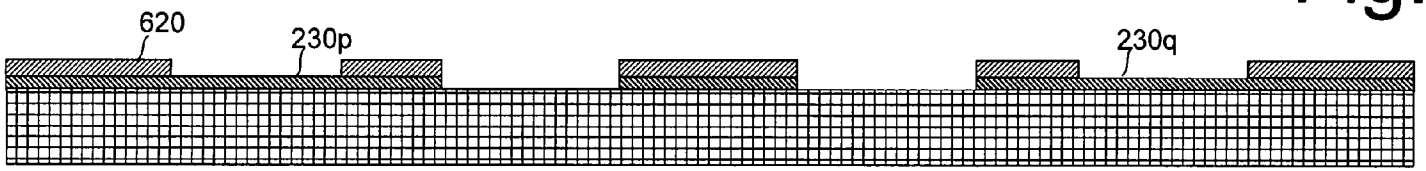
Figure 6H:
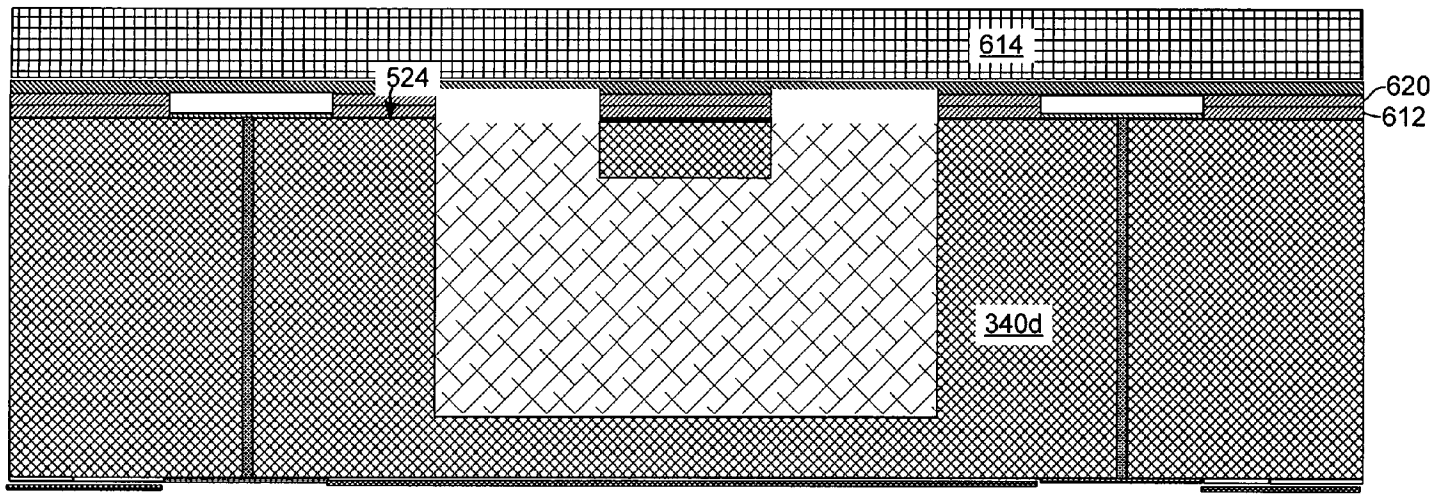
Figure 6I:
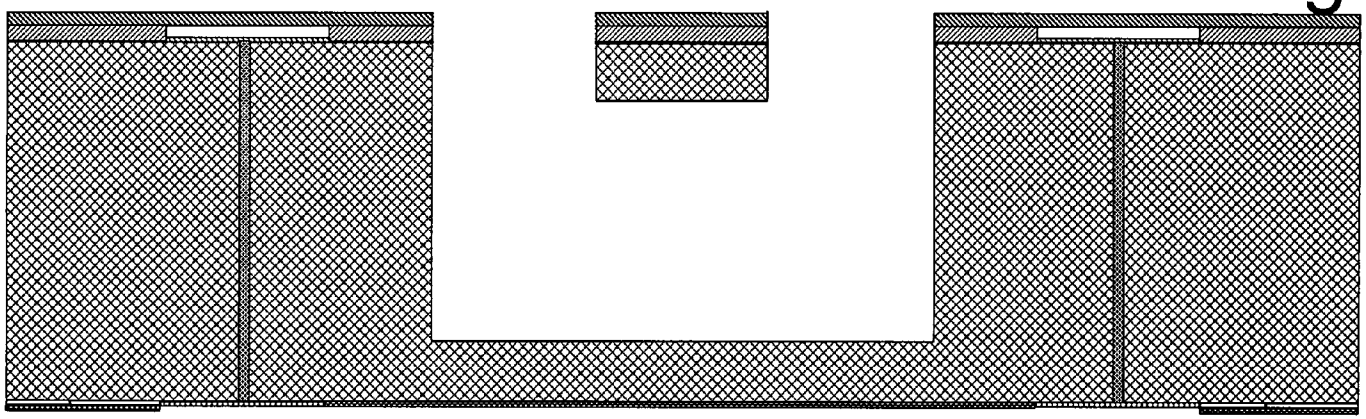
Figure 6J:
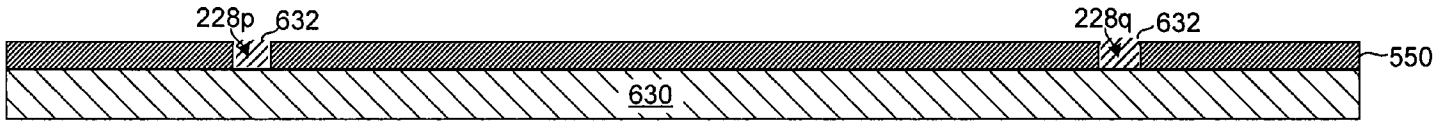
Figure 6K:
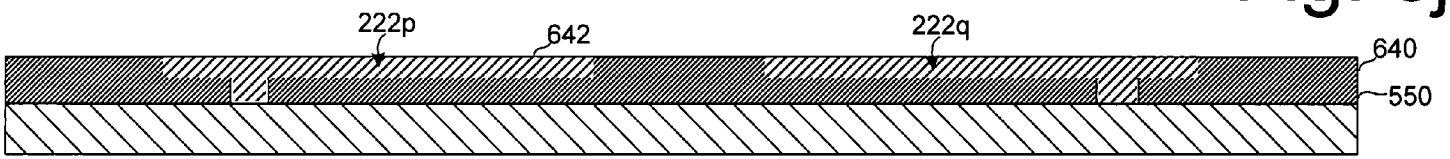
Figure 6L:
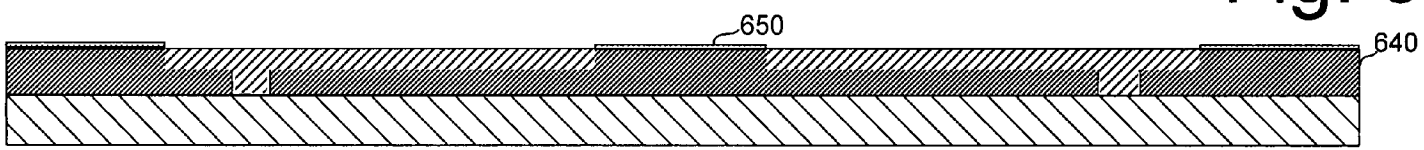
Figure 6M:
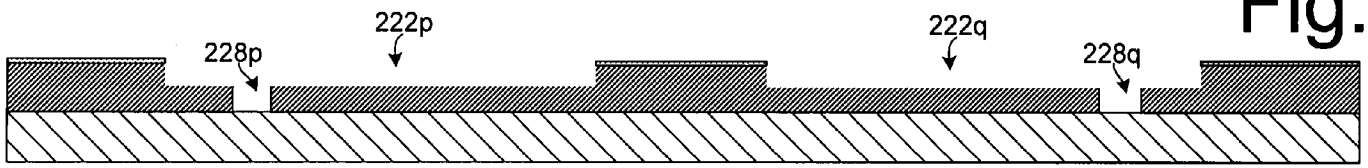
Figure 6N:
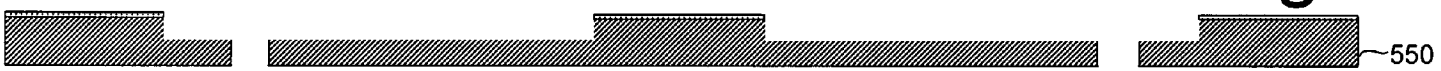
Figure 6O:
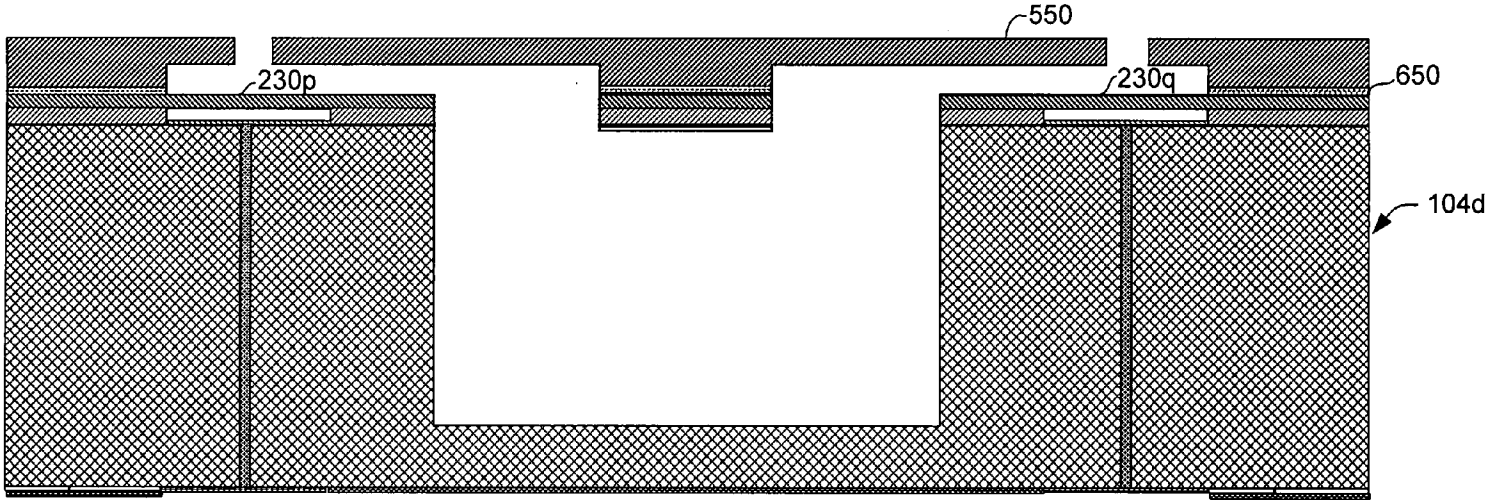
Figure 6P:
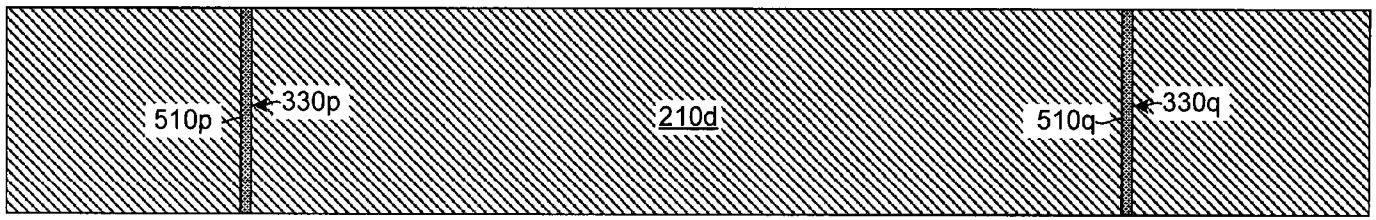
Figure 6Q:
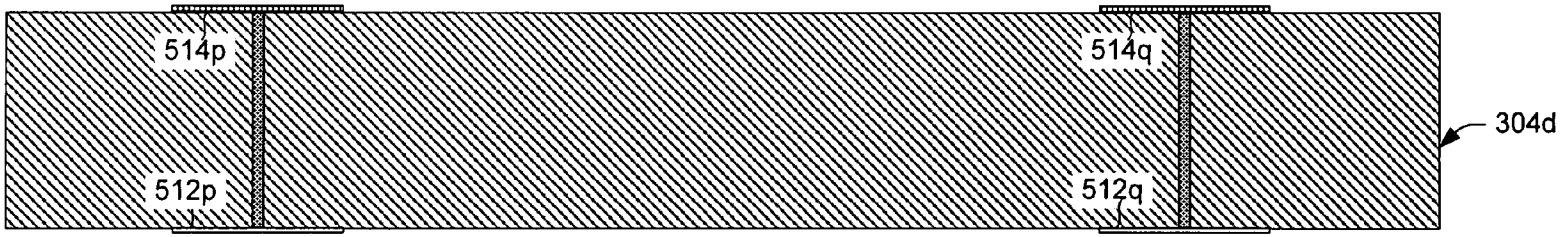
Figure 6R:
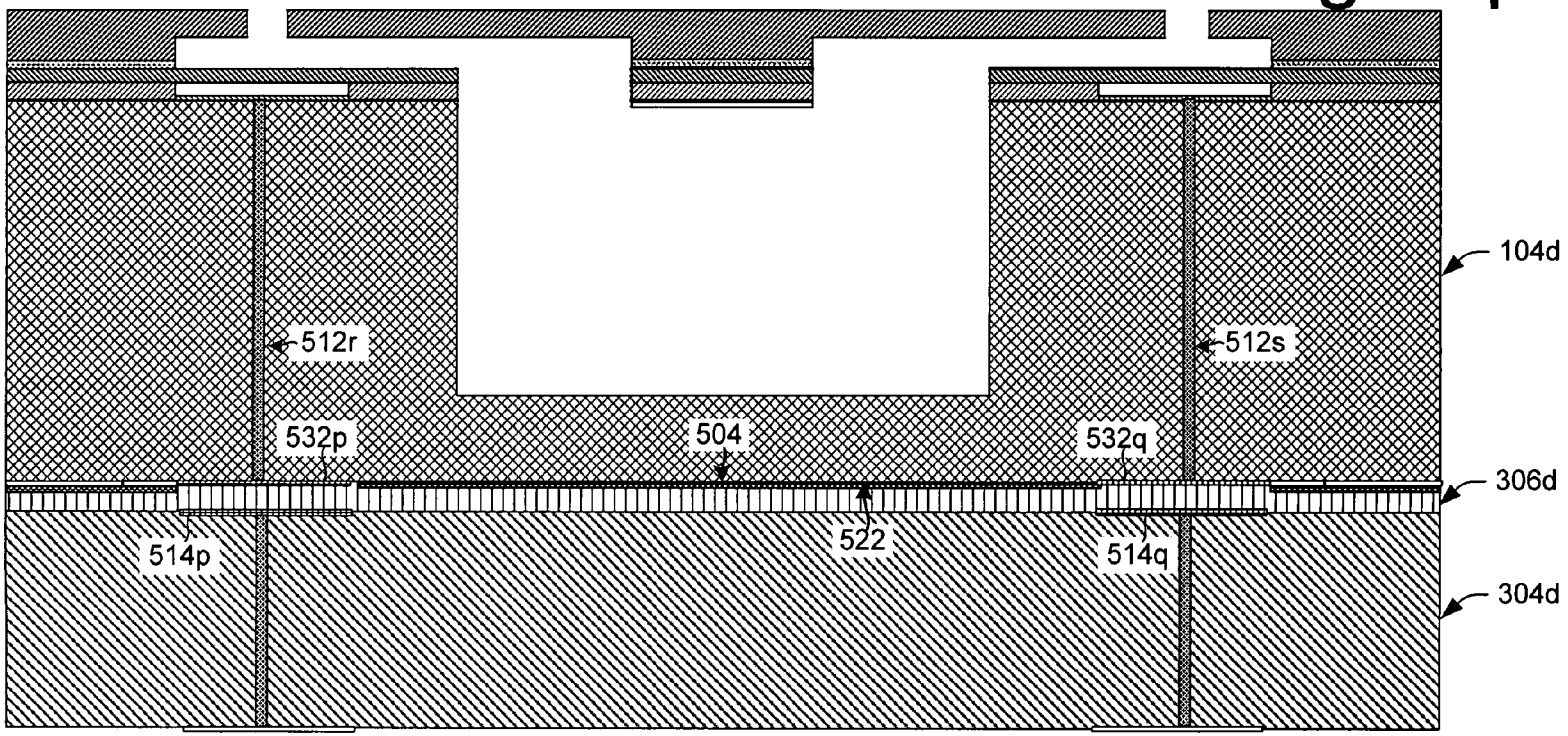

FIGS. 6*a*-6*r* illustrate process steps for forming a portion of an exemplary fluid-ejection device similar to that illustrated in FIG. 5. The skilled artisan should recognize other suitable processes.

Referring initially to FIG. 6*a*, a fluid channel 220*d* and conductors 336*p*, 336*q* are formed in substrate 340*d*. Substrate 340*d* can comprise any non-electrically conductive materials such as, but not limited to, ceramics such as silicate glass, quartz, and metal oxides, and plastics such as poly vinyl chloride and poly styrene.

In some formation processes substrate 340*d* can comprise multiple layers. For example a first layer 602*a* can be formed followed by a second layer 602*b* and then third layer 602*c*. In one particular formation process holes corresponding to central portion 530*p*, 530*q* of conductors 336*p*, 336*q* respectively are formed in first layer 602*a* comprised of green or unfired alumina. The holes can be filled with a conductive material such as nickel, copper, gold, silver, tungsten, carbon silicon and/or other conductive or semi-conductive materials or combinations thereof. In some embodiments the conductive material can comprise loosely associated particles such as a powder which is subsequently transformed into a solid component.

Referring again to FIG. 6*a*, where patterned second layer 602*b* comprising green alumina is positioned over first layer 602*a*. An area comprising fluid channel 220*d* is filled with one or more sacrificial fill materials 604 such as tungsten or other material. Holes corresponding to conductors' central portion 530*p*, 530*q* can be formed and filled as described above in relation to first layer 602*a*. Patterned third layer 602*c* comprising green alumina can then be positioned over second layer 602*b*. Holes corresponding to conductors' central portion 530*p*, 530*q* can be formed and filled as described above. The substrate then can be fired or heated which can harden the substrate material and/or the pin material. Firing or heating may also serve to bond the various layers such as 602*a*-602*c* to one another.

Terminal portions 532*p*-532*q* and 534*p*-534*q* and or fixed assemblies 232*p*, 232*q* can be formed on first and second surfaces 522, 524 respectively. Terminal portions 532*p*-532*q* and 534*p*-534*q*, and/or fixed assemblies 232*p*, 232*q* can comprise any suitable conducting or semiconducting material. Terminal portions 532*p*-532*q* and 534*p*-534*q* and/or fixed assemblies 232*p*, 232*q* can be formed before or after firing depending on the techniques employed. In one particular process terminal portions 532*p*-532*q* and 534*p*-534*q* fixed assemblies 232*p*, 232*q* can be photolithographically patterned utilizing known processes after firing.

Referring to FIG. 6*b*, resistors 548*p*, 548*q* are patterned over substrate's first surface 522 in electrical contact with terminal portion 532*p*, 532*q* respectively utilizing known processes. Resistor materials can include, but are not limited to, tungsten silicon nitride, doped or poly-silicon, tantalum metal and nitrides of silicon, titanium and/or boron.

Referring to FIG. 6*c*, conductors 546*p*, 546*q* are patterned over substrate's first surface 522 in electrical contact with resistors 548*p*, 548*q*. Known techniques such as a standard photolithography processes can be utilized to form the conductors.

Referring to FIG. 6*d* where an electrically isolative or insulative material 610 is patterned over substrate's first surface 522 leaving terminal portions 532*p*, 532*q* exposed. Electrically insulative materials can include silicon nitride or silicon carbide among others.

Referring to FIG. 6*e* where an electrically insulative or dielectric material 612 such as silicon dioxide is patterned over substrate's second surface 524 leaving fixed assemblies 232*p*, 232*q* exposed. Electrically insulative material 612 can be planarized to act as a spacer to maintain a desired distance between fixed assemblies 232*p*, 232*q* and a subsequent component as will become evident below.

Referring to FIG. 6*f* where another portion of an exemplary fluid ejection device is formed for subsequent assembly with the portion illustrated in FIG. 6*e*. Displaceable assembly 230*p*, 230*q* is positioned over at least a portion of a sacrificial carrier 614. In this process the displaceable assembly is formed over a surface 616 of carrier 614 and then patterned to form individual units such as displaceable assemblies 230*p*, 230*q*.

Referring to FIG. 6*g* where a dielectric or electrically insulative material 620 such as silicon dioxide is positioned over portions of displaceable assemblies 230*p*, 230*q*.

Referring to FIG. 6*h* where sacrificial carrier 614 is positioned over substrate's second surface 524. In one particular process dielectric material 612 is positioned against dielectric material 620 and the components can be exposed to conditions sufficient to bond the two dielectric layers. For purposes of illustration, FIG. 6*h* contains a line delineating dielectric material 612 from dielectric material 620, however, one homogenous material may be produced as a result of the bonding process.

Other embodiments may utilize other processes to form the displaceable assemblies over the substrate. In one such example a displaceable assembly may be laminated over substrate 340*d* with or without the aid of a sacrificial carrier.

Referring to FIG. 6*i*, sacrificial carrier 614 and sacrificial fill material 604 are removed utilizing known processes.

Referring to FIG. 6*j* nozzles are formed in orifice layer 540. Orifice layer 540 can be positioned on a mandrel 630 during formation of nozzles 228*p*, 228*q*. Orifice layer 540 can be formed from any suitable material utilizing known formation techniques. In this particular embodiment orifice layer 540 comprises a metal such as nickel. Other embodiments may utilize other metals or other material such as polymers. In some embodiments a sacrificial material 632 temporally can be positioned in the patterned areas during processing.

Referring to FIG. 6*k*, a chamber layer 640 is patterned over orifice layer 540 to form chambers 222*p*, 222*q*. Chamber layer 640 can comprise any suitable material such as various polymers. A sacrificial material 642 which may be the same material as sacrificial material 632 described above in reference to FIG. 6*j* can be positioned to temporally fill chambers 222*p*, 222*q*.

Referring to FIG. 6*l*, a bond layer 650 is patterned over chamber layer 640 utilizing known techniques.

Referring to FIG. 6*m* where sacrificial materials 632, 642 (illustrated in FIGS. 6*j*, 6*k*) can be removed utilizing known techniques from nozzles 228*p*, 228*q* and chamber 222*p*, 222*q* respectively.

Referring to FIG. 6*n* where mandrel 630 (illustrated in FIG. 6*j*) can be removed from orifice plate 550. Such removal can occur before or after positioning chamber layer 640 over substrate 340*d* as illustrated in FIG. 6*o*.

Referring to FIG. 6*o* where orifice layer 540 can be respectively positioned over displaceable assemblies 230*p*, 230*q* such that bond layer 650 bonds to portions of the displaceable assemblies to create a functional fluid assembly 104*d*.

Referring to FIG. 6*p*, central portions 510*p*, 510*q* of conductors 330*p*, 330*q* can be formed in substrate 210*d* in a manner similar to that described in relation to FIG. 6*a*.

Referring to FIG. 6*q* where terminal portions 512*p*, 512*q* and 514*p*, 514*q* are formed in a manner similar to that described above in relation to FIG. 6*a*. At least at this point in the processing, in some embodiments pin plate 304*d* may be incorporated as a portion of a vacuum tube in a known manner.

Referring now to FIG. 6*r*, pin plate 304*d* is positioned proximate fluid assembly 104*d* with interface 306*d* interposed therebetween. In this particular embodiment interface 306*d* comprises a deformable material which can serve to obviate any irregularities between pin plate's second surface 504 and fluid assemblies first surface 522. Example of deformable interface material can comprise anisotropically conductive polymer. One such example can comprise carbon fibers embedded in a silicone rubber matrix. Other deformable interface material can comprise other conductive polymeric materials such as metal wire embedded in rubber and metal particles embedded in epoxy resin, among other materials.

Other embodiments may utilize other interface materials. In one such example solder bumps can be positioned on one or both sets of terminal portions 514*p*, 514*q* and/or 532*p*, 532*q*. The pin plate 304*d* and the fluid assembly 104*d* can then be positioned proximate one another with the solder pads in a molten state until the solder resolidifies and can aid in maintaining the orientation and electrical connections therebetween. It should be noted that interface 306 is not needed and the conductors may run directly from the pin plate to ends 216 proximate displaceable assembly 226.

FIGS. 6*a*-6*r* illustrate process steps for forming an exemplary print head having conductive paths 512*r*, 512*s* which extend generally orthogonally to substrate's first surface 522. Other embodiments can have other configurations. For example, the conductive paths may have portions which are run parallel to the first surface of the fluid assembly's substrate. Alternatively or additionally, still other embodiments may have portions which run obliquely to the first surface. Such portion may occur in the pin plate substrate and/or the fluid-ejection substrate. One such example is described below in relation to FIG. 6*s*.

Figure 6S:
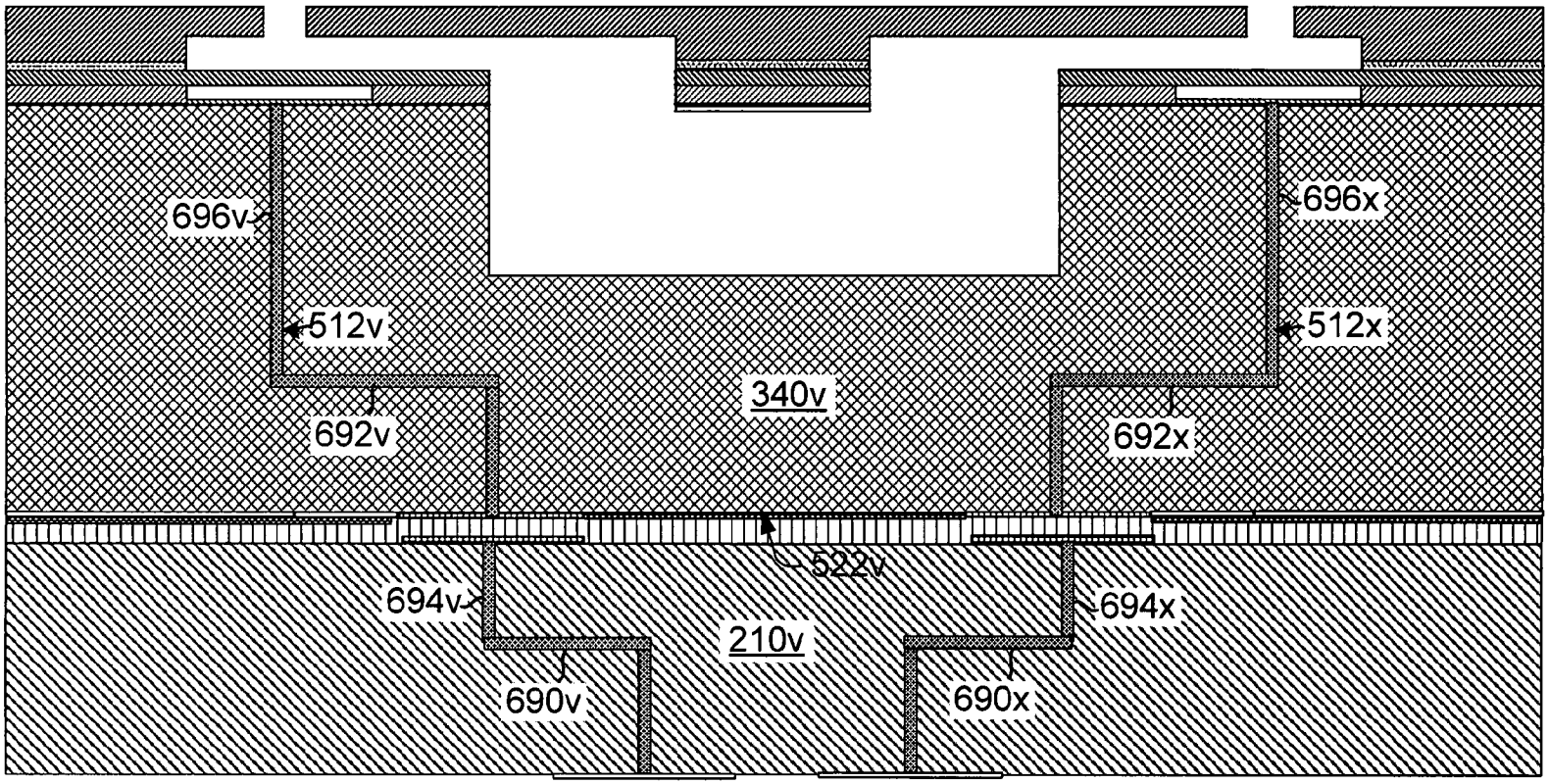

FIG. 6*s* illustrates an alternative embodiment where portions of the conductive paths 512*v*, 512*x* are generally parallel to first surface 522*v* while other different portions are oriented generally orthogonally to the first surface. In this particular configuration, conductor portions 690*v*, 690*x* and 692*v*, 692*x* are oriented generally parallel to first surface 522*v* while conductor portions 694*v*, 694*x* and 696*v*, 696*x* are oriented generally orthogonally to the first surface. The parallel portions can be formed utilizing the techniques described above where the substrates are formed in layers. Portions 690*v*, 690*x*, 692*v*, and 692*x* can be formed on a top surface of a first layer before positioning a second layer thereon. The portions can extend between the holes formed in the layers for the orthogonally oriented conductor portions as described above. The skilled artisan should recognize other exemplary configurations. For example, other embodiments may employ conductive paths having portions which are oblique relative to the first surface.

The embodiment illustrated in FIG. 6*s* can allow flexibility in the design layout of the various components comprising an exemplary fluid-ejection device. For example, such a configuration can allow greater conductor density in the fluid assembly or the pin plate as desired. Further, such a configuration can allow an evenly spaced array of conductors extending into the vacuum tube while allowing fluid drop generators to be arranged along fluid channels. Still other configurations should be recognized by the skilled artisan.

Figure 7:
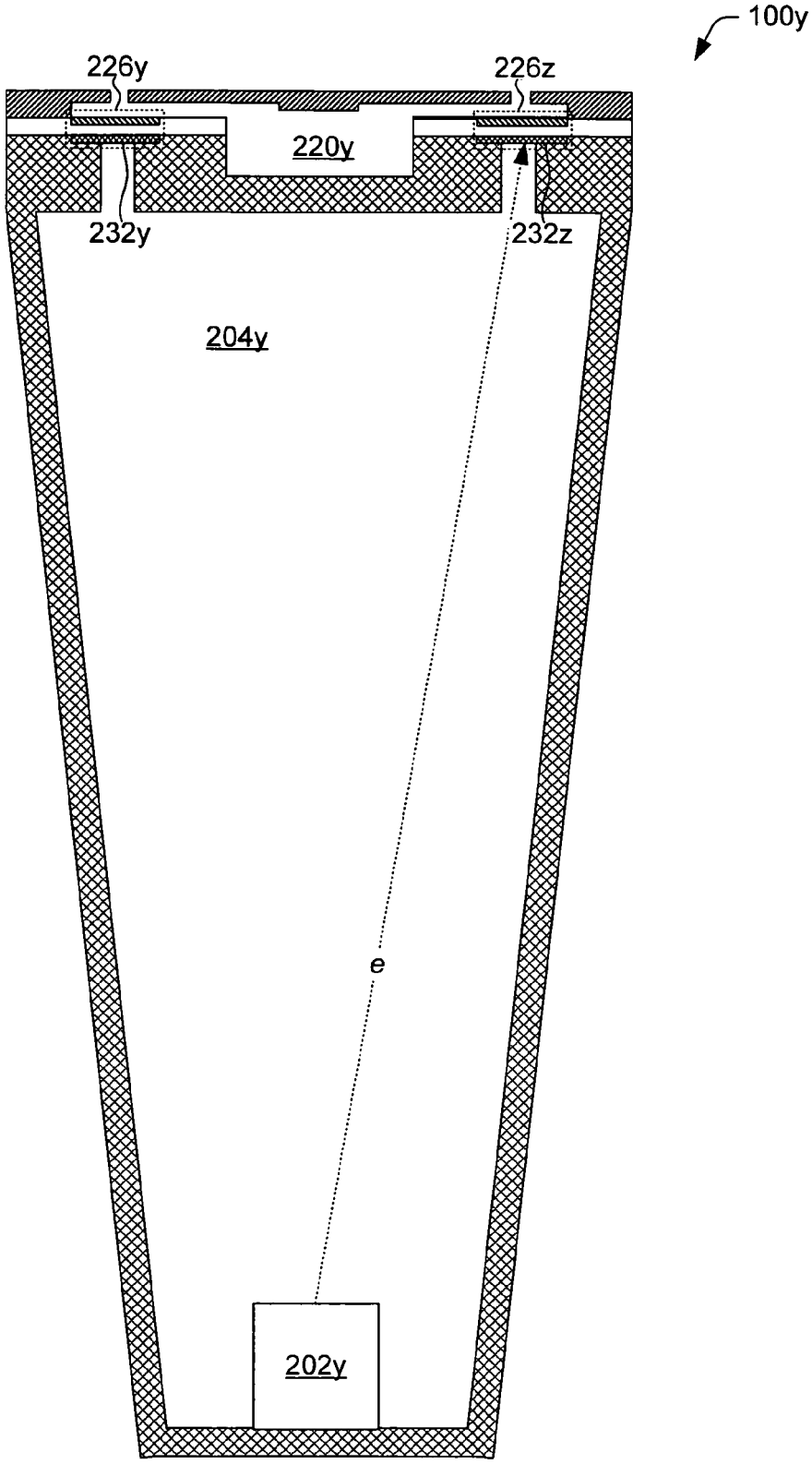

FIG. 7 illustrates another exemplary fluid ejection device 100*y*. In this particular embodiment fixed assemblies 232*y*, 232*z* of displacement units 226*y*, 226*z* can be formed into or over vacuum tube 204*y*. Vacuum tube 204*y* is configured to allow electron beam e to act directly upon displacement units 226*y*, 226*z*. In this particular embodiment the fixed assemblies overlay holes or gaps in the vacuum tube sufficient to allow electron beam e to act directly upon displacement units' fixed assemblies 232*y*, 232*z*. Here fixed assemblies 232*y*, 232*z* are formed from conductive materials and directing electron beam e at an individual fixed assembly can induce a charge thereon. Several examples of how such a configuration can be utilized to effect fluid drop ejection are described above. The skilled artisan should recognize many other exemplary configurations.

Figure 8:
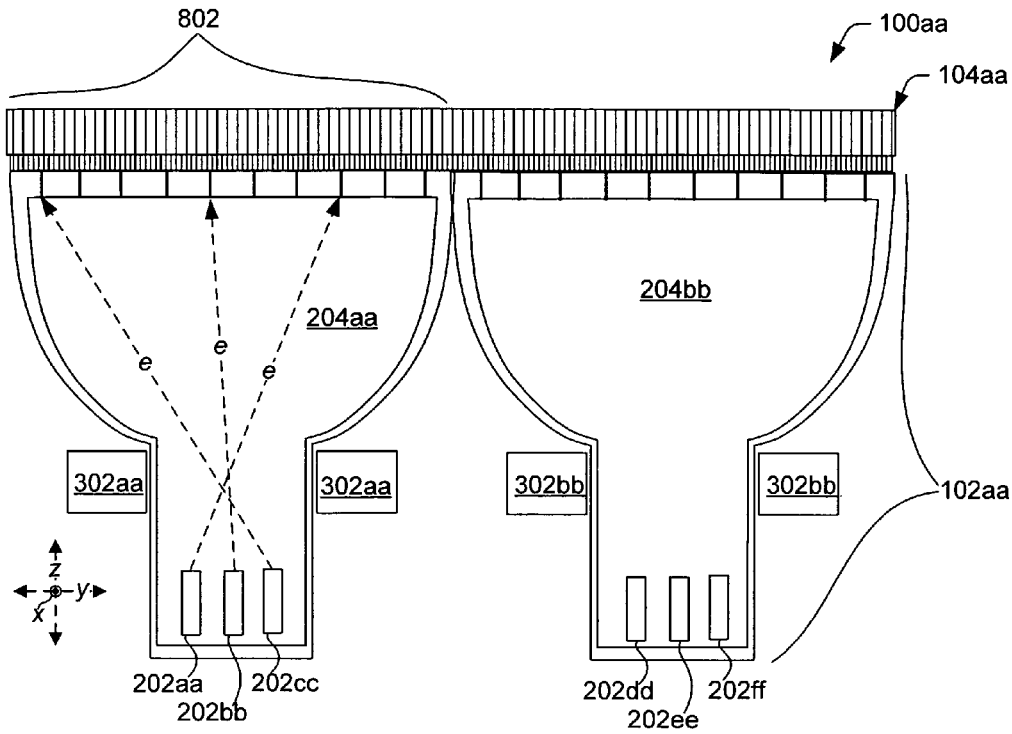

FIG. 8 illustrates still another exemplary fluid-ejection device 100*aa* comprising fluid assembly 104*aa* and generation assembly 102*aa*. In this embodiment generation assembly 102*aa* comprises two individual vacuum tubes 204*aa*, 204*bb*, associated electron guns 202*aa*-202*cc* and 202*dd*-202*ff*, and deflection mechanisms 302*aa*, 302*bb*. In this particular embodiment individual vacuum tubes and associated electron guns are configured to operate on a portion of the fluid assembly. For example, vacuum tube 204*aa* and associated electron guns 202*aa*-202*cc* are configured to operate on portion 802 of fluid assembly 104*aa*. The configuration illustrated in FIG. 8 can allow a single vacuum tube configuration to be manufactured in large quantities and associated with various sizes of fluid assemblies. For example, one embodiment may associate a generation assembly comprising a three by three array of the vacuum tubes illustrated in FIG. 8 with an appropriately sized fluid assembly to form a fluid-ejection device of a desired size.

Figure 9A:
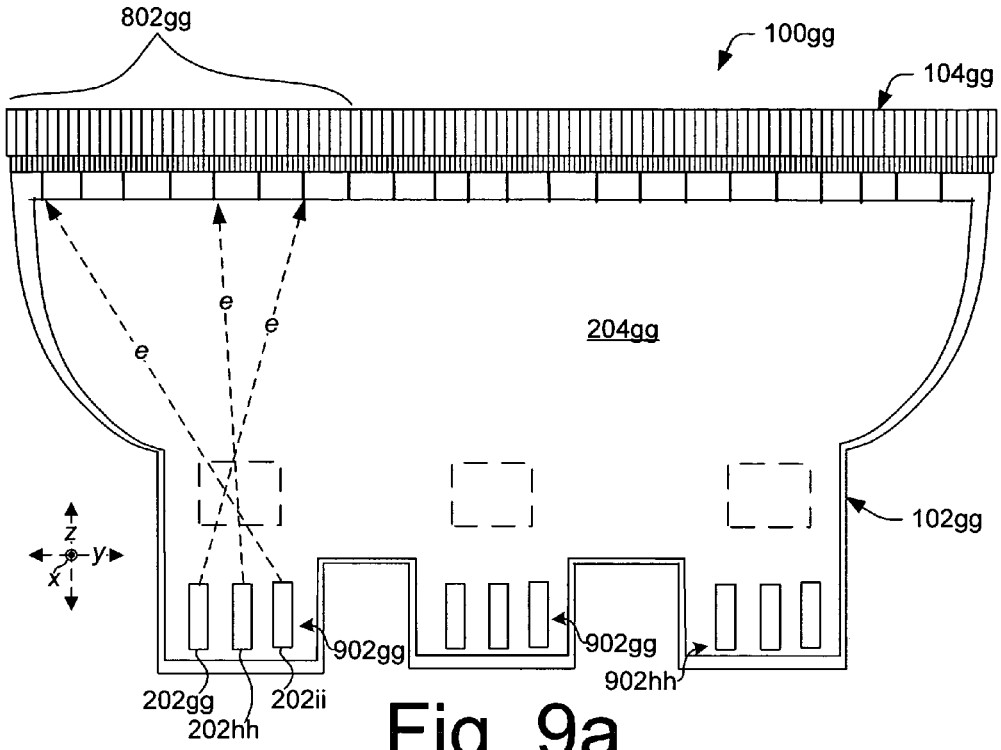
Figure 9B:
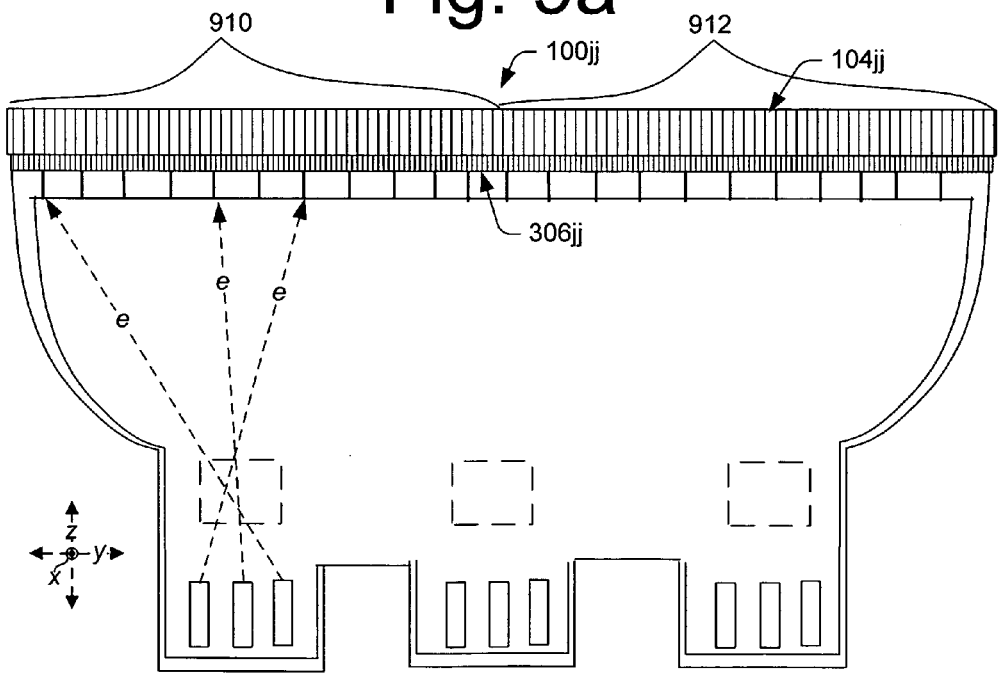

FIGS. 9*a*-9*b* illustrate additional exemplary fluid-ejection devices 100*gg*, 100*jj*. As illustrated in FIG. 9, generation assembly 102*gg* can comprise a single vacuum tube 204*gg* associated with two or more groups of electron guns. Each group of electron guns 902*gg*, 902*hh* and 902*ii* can comprise one or more electron guns. In this particular embodiment, individual groups of electron guns can comprise three electron guns. For example, group 902*gg* comprises electron guns 202*gg*-202*ii*. Individual groups of electron guns can be configured to operate on a portion of the fluid assembly. For example group 902*gg* can be configured to operate on portion 802*gg*. As illustrated in FIG. 9*a*, fluid assembly 104*gg* can comprise a single assembly of fluid drop generators. However, such need not be the case. As illustrated in FIG. 9*b* fluid assembly 104*jj* can comprise sub-assemblies of fluid drop generators associated to act as a single functional assembly. In this particular instance two sub-assemblies 910, 912 are illustrated. The sub-assemblies can be associated utilizing various suitable techniques. In this particular instance sub-assemblies 910, 912 can be associated, at least in part, by being bonded to interface 306*jj*. The skilled artisan should recognize still other exemplary configurations.

The described embodiments relate to fluid-ejection devices. The fluid-ejection device can comprise an electron beam generation assembly for effecting fluid ejection from individual fluid drop generators. In some of the embodiments the electron beam can cause a displacement unit to impart mechanical energy on fluid contained in the fluid drop generator sufficient to cause a fluid drop to be ejected from an associated nozzle.

It should be noted that while the application explains certain views of the figures in terms of the x, y, and z-axes, such description are not indicative of any specific geometery of the components described. Such x, y, and z-axes are merely described to facilitate an understanding of the location and position of components relative to one another in certain situations.

Although several embodiments are illustrated and described above, many other embodiments should also be recognized by the skilled artisan. For example, 'front' or 'face' shooter fluid assemblies are described above. The skilled artisan should recognize that many other embodiments can be configured utilizing 'side' or 'edge' shooter configurations. This provides just one example that although specific structural features and methodological steps are described, it is to be understood that the inventive concepts defined in the appended claims are not necessarily limited to the specific features or steps described. Rather, the specific features and steps are disclosed as forms of implementation of the inventive concepts.

What is claimed is:

1. A fluid-ejection device comprising:

at least one nozzle operatively associated with at least one displacement unit configured to impart mechanical energy on fluid associated with the nozzle to cause a fluid drop to be ejected from the nozzle; and, a cathode ray tube configured to supply energy to selectively effect the displacement unit to control ejection of the fluid drop.

2. The fluid-ejection device of claim 1, wherein the cathode ray tube comprises a cathode ray pin tube having at least one conductor configured to receive an electron beam generated by the cathode ray tube, the at least one conductor being electrically coupled to an individual displacement unit via a conductive path.

3. The fluid-ejection device of claim 2, wherein the cathode ray pin tube is configured to emit an electron beam along a first axis and wherein the at least one conductor extends along a second axis which is generally orthogonal to the first axis.

4. The fluid-ejection device of claim 2, wherein the cathode ray pin tube is configured to emit an electron beam along a first axis and wherein conductor extends along a second axis which is generally parallel to the first axis.

5. The fluid-ejection device of claim 2, wherein the cathode ray pin tube is configured to emit an electron beam along a first axis and wherein conductive pin extends along a second axis which is generally obtuse to the first axis.

6. The fluid-ejection device of claim 1, wherein the at least one displacement unit comprises a fixed assembly and a displaceable assembly and wherein the displaceable assembly is configured to move relative to the fixed assembly to impart the mechanical energy on the liquid.

7. The fluid-ejection device of claim 1, wherein the at least one displacement unit comprises multiple independently controllable displacement units associated with the nozzle.

8. The fluid-ejection device of claim 1, wherein the displacement unit comprises a deformable membrane.

9. The fluid-ejection device of claim 1, wherein the at least one nozzle comprises a number of nozzles, and wherein the at least one displacement unit consists of a number of displacement units which equals a number of nozzles.

10. A fluid-ejection device comprising:

a plurality of fluid drop generators, individual fluid drop generators comprising a displaceable assembly for ejecting fluid; and, a cathode ray tube having multiple conductors positioned therethrough which are independently addressable by an electron beam generated by the cathode ray tube configured to deliver electrical current proximate to individual fluid drop generators to cause fluid to be ejected therefrom.

11. The fluid-ejection device of claim 10, wherein the displaceable assembly is configured to have a non-displaced condition and a displaced condition and wherein delivering energy from the electron beam generation assembly proximate the displaceable assembly causes the displaceable assembly to assume the displaced condition.

12. The fluid-ejection device of claim 11, wherein the displaceable assembly is configured such that ceasing to deliver energy from the electron beam generation assembly proximate the displaceable assembly causes the displaceable assembly to assume the non-displaced condition which imparts mechanical energy upon fluid proximate the displaceable assembly.

13. The fluid-ejection device of claim 10 further comprising a voltage source configured to deliver electrical energy proximate the displaceable assembly sufficient to cause the displaceable assembly to assume a displaced condition and wherein delivering energy from the electron beam generation assembly proximate the displaceable assembly causes the displaceable assembly to assume the non-displaced condition and thereby exerting mechanical energy on fluid proximate the displaceable assembly sufficient to cause fluid to be ejected from an associated nozzle.

14. The fluid-ejection device of claim 10, wherein the displaceable assembly comprises a portion of a displacement unit and wherein the electron beam acts directly upon the displacement unit.

15. The fluid-ejection device of claim 10, wherein the displaceable assembly comprises a portion of a displacement unit and wherein the electron beam generated by the electron beam generation assembly acts upon the displacement unit via one of the multiple conductors.

16. The fluid-ejection device of claim 10 further comprising an interface interposed between the cathode ray tube and the plurality of fluid drop generators and configured to electrically couple individual conductors of the cathode ray tube with individual fluid drop generators.

17. A fluid-ejection device comprising:

a fluid assembly defining a plurality of nozzles for ejecting fluid droplets;

a cathode ray pin tube associated with the fluid assembly and configured to selectively effect ejection of fluid droplets from individual nozzles; and an interface interposed between the fluid assembly and the cathode ray pin tube through which individual conductors of the fluid assembly are electrically coupled to individual conductors of the cathode ray pin tube.

18. The fluid-ejection device of claim 17, wherein the fluid assembly comprises a plurality of displacement units, individual displacement units associated with an individual nozzle and configured to impart mechanical energy on fluid proximate the displacement unit sufficient to cause fluid to be ejected from an individual nozzle.

19. The fluid-ejection device of claim 18, wherein the cathode ray pin tube comprises a plurality of electrically isolated conductors and wherein the fluid assembly comprises a plurality of conductors individually coupled to the displacement units and wherein individual conductors of the cathode ray pin tube are electrically coupled to individual conductors of the fluid assembly.

20. The fluid-ejection device of claim 17, wherein the cathode ray pin tube is a modular unit and the fluid assembly is a modular unit and wherein the cathode ray pin tube assembly and the fluid assembly can be removably associated.

21. A fluid-ejection device comprising:

a fluid assembly comprising:

at least one displacement unit configured to impart mechanical energy on a fluid, and an associated nozzle through which the fluid can be selectively ejected; and, a cathode ray pin tube configured to modulate and steer an electron beam to energize individual displacement units sufficient to cause a fluid drop to be ejected from the associated nozzle.

22. The fluid-ejection device of claim 21, wherein the electron beam generation assembly comprises deflection plates configured to steer the electron beam.

23. The fluid-ejection device of claim 21, wherein the electron beam generation assembly comprises a deflection mechanism configured to steer the electron beam.

24. The fluid-ejection device of claim 21, wherein the electron beam generation assembly is configured to control the current of the electron beam as a means to modulate the electron beam.

25. The fluid-ejection device of claim 21, wherein the electron beam generation assembly comprises at least one field emitter.

26. A fluid-ejection device comprising:

a means for imparting mechanical energy on fluid contained in an associated chamber sufficient to cause fluid to be ejected from the chamber;

a first conductor configured to deliver a first signal to the means for imparting mechanical energy; and, a cathode ray tube configured to deliver energy to the first conductor.

27. The fluid-ejection device of claim 26, wherein the means for imparting mechanical energy comprises a displaceable assembly and a fixed assembly.

28. The fluid-ejection device of claim 26, wherein the electron beam source is configured to deliver the energy independent of any fluid-ejection device integrated control circuitry.

29. A fluid-ejection device comprising:

a plurality of chambers, individual chambers associated with a nozzle and a structure configured to move from a first position to a second position to cause fluid to be ejected from the nozzle;

a plurality of conductors, individual conductors being electrically coupled to individual structures; and, a cathode ray tube configured to impart energy upon individual conductors to cause the structure to move from the first position to the second position.

30. The fluid-ejection device of claim 29, wherein the electron beam source is configured to emit an electron beam along a first axis and wherein the plurality of conductors extends along a second axis which is generally orthogonal to the first axis.

31. The fluid-ejection device of claim 29, wherein the electron beam source is configured to emit an electron beam along a first axis and wherein the plurality of conductors extends along a second axis which is generally parallel to the first axis.

32. The fluid-ejection device of claim 29, wherein the electron beam source is configured to emit an electron beam along a first axis and wherein the plurality of conductors extends along a second axis which is generally obtuse to the first axis.

33. The fluid-ejection device of claim 29, wherein the structure comprises a deformable membrane.

* * * * *